US006918234B2

(12) United States Patent
Thomas et al.

(10) Patent No.: US 6,918,234 B2
(45) **Date of Patent: *Jul. 19, 2005**

(54) PROCESS FOR ATTACHING SLIDER-OPERATED CLOSURE ON FORM-FILL-SEAL PACKAGING MACHINERY

(75) Inventors: Toby R. Thomas, Victor, NY (US); Alexander R. Provan, Canandaigua, NY (US); Craig E. Cappel, Pittsford, NY (US); Larry E. Benedict, Palmyra, NY (US); Gerald R. Winiecki, Suring, WI (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/368,125

(22) Filed: Feb. 18, 2003

(65) Prior Publication Data

US 2003/0208989 A1 Nov. 13, 2003

Related U.S. Application Data

(60) Provisional application No. 60/358,527, filed on Feb. 21, 2002.

(51) Int. Cl.[7] ..... B65B 9/00

(52) U.S. Cl. ..... 53/450; 53/412; 53/133.4; 53/139.2; 53/562; 53/455; 493/213; 493/214; 493/927

(58) Field of Search ..... 53/412, 133.4, 53/139.2, 450, 562, 455; 493/213, 214, 927

(56) References Cited

U.S. PATENT DOCUMENTS

| | | | | |
|---|---|---|---|---|
| 3,381,592 | A | 5/1968 | Ravel | 93/8 |
| 3,473,589 | A | 10/1969 | Götz | 150/3 |
| 3,532,571 | A | 10/1970 | Ausnit | 156/91 |
| RE27,174 | E | 9/1971 | Ausnit | 150/3 |
| 3,608,439 | A | 9/1971 | Ausnit | 93/35 R |
| 3,613,524 | A | 10/1971 | Behr et al. | 93/33 R |
| 3,701,191 | A | 10/1972 | Laguerre | 29/207.5 SL |
| 3,701,192 | A | 10/1972 | Laguerre | 29/207.5 SL |
| 3,785,111 | A | 1/1974 | Pike | 53/14 |
| 3,839,128 | A | 10/1974 | Arai | 156/583 |
| 3,948,705 | A | 4/1976 | Ausnit | 156/73.4 |
| 4,094,729 | A | 6/1978 | Boccia | 156/515 |
| 4,196,030 | A | 4/1980 | Ausnit | 156/91 |

(Continued)

FOREIGN PATENT DOCUMENTS

| | | | |
|---|---|---|---|
| EP | 0 939 034 A1 | 9/1999 | B65B/61/18 |
| EP | 0 978 450 A1 | 2/2000 | B65B/9/20 |
| EP | 1 026 077 A2 | 8/2000 | B65B/9/08 |
| GB | 2 085 519 A | 4/1982 | A44B/19/62 |
| WO | WO 99/24325 A1 | 5/1999 | B65B/61/18 |
| WO | WO 01/32521 A1 | 5/2001 | B65D/33/00 |

*Primary Examiner*—John Sipos
*Assistant Examiner*—Michelle Lopez
(74) *Attorney, Agent, or Firm*—Jenkens & Gilchrist

(57) ABSTRACT

The present invention relates to a process used for packaging a product in a web of material that has a zipper attached thereto. The process includes providing a web of material having first and second edges and a zipper including first and second interlocking members. The first and second interlocking members of the zipper are interlocked together. The first interlocking member of the zipper is attached to the web at an intermediate portion of the web between the first and second edges of the web. The second interlocking member has an attachment region that is facing away from the web. One edge of the web is folded away from the zipper and toward the other edge of the web. Unit operations are performed on the zipper to create zipper segments from the zipper while the zipper is exposed. Each of the zipper segments is associated with an individual food package made from the web.

24 Claims, 19 Drawing Sheets

U.S. PATENT DOCUMENTS 4,240,241 A 12/1980 Sanborn, Jr. ..... 53/412
4,241,865 A 12/1980 Ferrell ..... 229/62
4,246,288 A 1/1981 Sanborn, Jr. ..... 426/122
4,277,241 A 7/1981 Schulze ..... 493/196
4,341,575 A 7/1982 Herz ..... 156/66
4,355,494 A 10/1982 Tilman ..... 53/416
4,372,793 A 2/1983 Herz ..... 156/66
4,415,386 A 11/1983 Ferrell et al. ..... 156/64
4,430,070 A 2/1984 Ausnit ..... 493/215
4,437,293 A 3/1984 Sanborn, Jr. ..... 53/412
4,517,788 A 5/1985 Scheffers ..... 53/459
4,528,224 A 7/1985 Ausnit ..... 428/36
4,563,319 A 1/1986 Ausnit et al. ..... 264/146
4,581,006 A 4/1986 Hugues et al. ..... 493/213
4,582,549 A 4/1986 Ferrell ..... 156/66
4,589,145 A 5/1986 Van Erden et al. ..... 383/5
4,601,694 A 7/1986 Ausnit ..... 493/381
4,617,683 A 10/1986 Christoff ..... 383/63
4,620,320 A 10/1986 Sullivan ..... 383/79
4,651,504 A 3/1987 Bentsen ..... 53/452
4,655,862 A 4/1987 Christoff et al. ..... 156/66
4,663,915 A 5/1987 Van Erden et al. ..... 53/450
4,666,536 A 5/1987 Van Erden et al. ..... 156/64
4,673,383 A 6/1987 Bentsen ..... 493/381
4,691,372 A 9/1987 Van Erden ..... 383/63
4,703,518 A 10/1987 Ausnit ..... 383/63
4,709,398 A 11/1987 Ausnit ..... 383/63
4,709,533 A 12/1987 Ausnit ..... 53/451
4,710,157 A 12/1987 Posey ..... 493/213
4,782,951 A 11/1988 Griesbach et al. ..... 206/484
4,787,880 A 11/1988 Ausnit ..... 493/213
4,790,126 A 12/1988 Boeckmann ..... 53/451
4,807,300 A 2/1989 Ausnit et al. ..... 383/65
4,812,074 A 3/1989 Ausnit et al. ..... 493/213
4,840,012 A 6/1989 Boeckmann ..... 53/410
4,840,611 A 6/1989 Van Erden et al. ..... 493/213
4,844,759 A 7/1989 Boeckmann ..... 156/66
4,850,178 A 7/1989 Ausnit ..... 53/570
4,876,842 A 10/1989 Ausnit ..... 53/410
4,878,987 A 11/1989 Ven Erden ..... 156/519
4,892,414 A 1/1990 Ausnit ..... 383/63
4,892,512 A 1/1990 Branson ..... 493/194
4,894,975 A 1/1990 Ausnit ..... 53/412
4,909,017 A 3/1990 McMahon et al. ..... 53/410
4,924,655 A 5/1990 Posey ..... 53/128
4,925,318 A 5/1990 Sorensen ..... 383/63
4,929,225 A 5/1990 Ausnit et al. ..... 493/213
4,941,307 A 7/1990 Wojcik ..... 53/412
4,969,309 A 11/1990 Schwarz et al. ..... 53/412
4,974,395 A 12/1990 McMahon ..... 53/551
4,993,212 A 2/1991 Veoukas ..... 53/451
5,005,707 A 4/1991 Hustad et al. ..... 206/632
5,014,498 A 5/1991 McMahon ..... 53/451
5,027,584 A 7/1991 McMahon et al. ..... 53/451
5,036,643 A 8/1991 Bodolay ..... 53/128.1
5,042,224 A 8/1991 McMahon ..... 53/133.4
5,046,300 A 9/1991 Custer et al. ..... 53/412
5,047,002 A 9/1991 Zieke et al. ..... 493/394
5,063,639 A 11/1991 Boeckmann et al. .... 24/30.5 R
5,067,208 A 11/1991 Herrington, Jr. et al. ..... 24/400
5,072,571 A 12/1991 Boeckmann ..... 53/133.4
5,085,031 A 2/1992 McDonald ..... 53/412
5,088,971 A 2/1992 Herrington ..... 493/203
5,092,831 A 3/1992 James et al. ..... 493/394
5,096,516 A 3/1992 McDonald et al. ..... 156/66
5,105,603 A 4/1992 Natterer ..... 53/412
5,107,658 A 4/1992 Hustad et al. ..... 53/408
5,111,643 A 5/1992 Hobock ..... 53/551
5,116,301 A 5/1992 Robinson et al. ..... 493/215
5,127,208 A 7/1992 Custer et al. ..... 53/412
5,131,121 A 7/1992 Herrington, Jr. et al. ..... 24/436
5,147,272 A 9/1992 Richison et al. ..... 493/195
5,161,286 A 11/1992 Herrington, Jr. et al. ..... 24/387
5,179,816 A 1/1993 Wojnicki ..... 53/133.4
5,188,461 A 2/1993 Sorensen ..... 383/63
5,211,482 A 5/1993 Tilman ..... 383/202
5,247,781 A 9/1993 Runge ..... 53/412
5,254,073 A 10/1993 Richison et al. ..... 493/195
5,259,904 A 11/1993 Ausnit ..... 156/244.15
5,273,511 A 12/1993 Boeckman ..... 493/195
5,322,579 A 6/1994 Van Erden ..... 156/66
5,334,127 A 8/1994 Bruno et al. ..... 493/194
5,383,989 A 1/1995 McMahon ..... 156/66
5,400,565 A 3/1995 Terminella et al. ..... 53/133.4
5,400,568 A 3/1995 Kanemitsu et al. ..... 53/412
5,405,478 A 4/1995 Richardson et al. ..... 156/308.4
5,405,629 A 4/1995 Marnocha et al. ..... 426/122
5,412,924 A 5/1995 Ausnit ..... 53/412
5,415,904 A 5/1995 Takubo et al. ..... 428/35.2
5,425,216 A 6/1995 Ausnit ..... 53/410
5,425,825 A 6/1995 Rasko et al. ..... 156/66
5,431,760 A 7/1995 Donovan ..... 156/66
5,435,864 A 7/1995 Machacek et al. ..... 156/66
5,442,837 A 8/1995 Morgan ..... 24/400
5,448,807 A 9/1995 Herrington, Jr. ..... 24/399
5,470,156 A 11/1995 May ..... 383/210
5,482,375 A 1/1996 Richardson et al. ..... 383/64
5,489,252 A 2/1996 May ..... 383/210
5,492,411 A 2/1996 May ..... 383/5
5,505,037 A 4/1996 Terminella et al. ..... 53/133.4
5,509,735 A 4/1996 May ..... 383/210
5,511,884 A 4/1996 Bruno et al. ..... 383/63
5,519,982 A 5/1996 Herber et al. ..... 53/412
5,525,363 A 6/1996 Herber et al. ..... 426/130
5,542,902 A 8/1996 Richison et al. ..... 493/195
5,551,127 A 9/1996 May ..... 24/30.5 R
5,551,208 A 9/1996 Van Erden ..... 53/139.2
5,557,907 A 9/1996 Malin et al. ..... 53/139.2
5,558,613 A 9/1996 Tilman et al. ..... 493/214
5,561,966 A 10/1996 English ..... 53/412
5,564,259 A 10/1996 Stolmeier ..... 53/410
5,573,614 A 11/1996 Tilman et al. ..... 156/66
5,592,802 A 1/1997 Malin et al. ..... 53/133.4
5,603,202 A 2/1997 Hanagata ..... 53/550
5,613,934 A 3/1997 May ..... 493/214
5,628,566 A 5/1997 Schreiter ..... 383/63
5,647,671 A 7/1997 May ..... 383/210
5,669,715 A 9/1997 Dobreski et al. ..... 383/5
5,672,234 A 9/1997 Rodenstein et al. ..... 156/494
5,682,730 A 11/1997 Dobreski ..... 53/469
5,706,635 A 1/1998 Simmons ..... 53/511
5,725,312 A 3/1998 May ..... 383/210
5,782,733 A 7/1998 Yeager ..... 493/213
5,788,378 A 8/1998 Thomas ..... 383/63
5,823,933 A 10/1998 Yeager ..... 493/213
5,833,791 A 11/1998 Bryniarski et al. .... 156/244.25
5,906,438 A 5/1999 Laudenberg ..... 383/63
5,956,924 A 9/1999 Thieman ..... 53/412
6,044,621 A 4/2000 Malin et al. ..... 53/412
6,138,436 A 10/2000 Malin et al. ..... 53/133.4
6,138,439 A 10/2000 McMahon et al. ..... 53/412
6,161,271 A 12/2000 Schreiter ..... 29/408
6,212,857 B1 4/2001 Van Erden ..... 53/412
6,216,423 B1 4/2001 Thieman ..... 53/412
6,279,298 B1 8/2001 Thomas et al. ..... 53/412
6,286,189 B1 9/2001 Provan et al. ..... 24/30.5 R
6,289,561 B1 9/2001 Provan et al. ..... 24/415
6,292,986 B1 9/2001 Provan et al. ..... 24/415
6,293,896 B1 9/2001 Buchman ..... 493/213
6,327,754 B1 12/2001 Belmont et al. ..... 24/400
6,347,437 B2 2/2002 Provan et al. ..... 24/400
6,360,513 B1 3/2002 Strand et al. ..... 53/412
6,363,692 B2 4/2002 Thieman ..... 53/412
6,412,254 B1 7/2002 Tilman et al. ..... 53/412
6,427,421 B1 8/2002 Belmont et al. ..... 53/412
6,470,551 B1 10/2002 Provan et al. ..... 29/408
6,499,272 B2 12/2002 Thieman ..... 53/412
6,526,726 B1 * 3/2003 Strand et al. ..... 53/412

* cited by examiner 720
722

738
732
722
736
732

722
738
736
734

722
738
736
740

738
722
740
736

742
738
736
743
742
734

738
736
740
743
750

738
736
743
750

738
736

756
738b
754
754
736b
738a
755
743
736a

PROCESS FOR ATTACHING SLIDER-OPERATED CLOSURE ON FORM-FILL-SEAL PACKAGING MACHINERY

RELATED APPLICATION

This application claims the benefit of priority of U.S. Provisional Patent Application No. 60/358,527, filed Feb. 21, 2002.

FIELD OF THE INVENTION

The present invention generally relates to machines for forming, filling, and sealing plastic bags and methods for using such machines.

BACKGROUND OF THE INVENTION

Plastic packages are popular for storing food products and other items. Recloseable packages that can be securely closed and reopened are particularly popular due to their ability to maintain freshness of the food stored in the package and to minimize leakage to and from the package. Thus, recloseable packages are very common, especially in the food industry. For example, nuts, candy, snacks, cheese, other food, and non-food products can be packed in these packages by form, fill, and seal machines and sold to consumers.

Recloseable packages are typically made to be recloseable via the use of a recloseable feature such as a resealable adhesive seal or a recloseable zipper. Recloseable zippers can be opened and closed either by finger pressure or by use of an auxiliary slider mechanism. Because of the mechanical sealing provided by a zipper, the zipper has become the preferred type of recloseable feature.

Plastic bags with recloseable zippers are commonly formed on vertical and horizontal form, fill, and seal machines. Vertical form, fill, and seal machines typically wrap film around a tube. A vertical seal at the free edges of the web of material is made to develop the tube and a seal at the top or bottom of the tube is made to form a bag. The product is dropped through the tube into the bag. Overwrap form, fill, and seal machines typically wrap film around a product and seal the film to form a bag. Horizontal form, fill, and seal machines generally fold the web and provide two seals that are perpendicular to the fold to create a three-sided package. The product is then placed through the opening in the package and the opening is then sealed.

The recloseable zippers are placed along the web of material at the region that will eventually be the opening of the package. During the form, fill, and seal process, the zipper is usually closed and the two tracks of the zipper are sealed to the web. To form and fill bags with the slider for the zippers requires mounting sliders onto zippers, securing the zippers to bag film, forming a bag from the film, and filling the bag with product. It is desirable to perform all of these steps continuously in order to maximize efficiency and minimize the cost of the bags.

SUMMARY OF THE INVENTION

The present invention relates to a process used for packaging a product in a web of material that has a zipper attached thereto. The process includes providing a web of material having first and second edges and a zipper including first and second interlocking members. The first and second interlocking members of the zipper are interlocked together. The first interlocking member of the zipper is attached to the web at an intermediate portion of the web between the first and second edges. The second interlocking member has an attachment region that is facing away from the web.

Because the zipper is at an intermediate region of the web and requires some operations (i.e., unit operations, such as attaching a slider thereto) to make the zipper suitable for each individual package formed from the web, the inventive process includes exposing the zipper. This is typically accomplished by folding one edge of the web away from the zipper and toward the other edge of the web. The unit operations are performed on the zipper to create zipper segments from the zipper while the zipper is exposed. Each of the zipper segments is associated with an individual package made from the web.

Product is then placed on the web. The material of the web is sealed to develop side seals for the package. The free edges of the web are also sealed to develop a header at the top of the package or an intermediate flange. The web is also sealed to the second interlocking member at its attachment region.

The above summary of the present invention is not intended to represent each embodiment or every aspect of the present invention. For example, there are several alternative methods for folding the web to expose the zipper and several ways to seal the product within the package after the folding process has exposed the zipper. The details of these alternatives are provided in the Figures and the detailed description which follow.

BRIEF DESCRIPTION OF THE DRAWINGS

The foregoing and other advantages of the invention will become apparent upon reading the following detailed description and upon reference to the drawings.

Figure 1A:
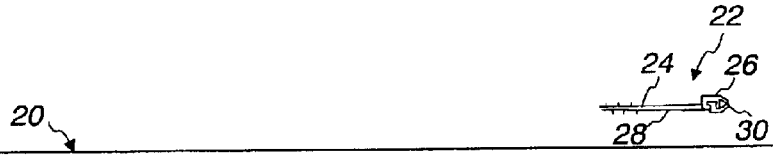
FIGS. 1A–1H illustrate one method of a form, fill, and seal process according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Referring initially to FIGS. 1A–1H, a web of material 20 is moved in a generally horizontal direction and a zipper 22 is disposed adjacent to the web 20. The zipper 22 includes a first fin 24 having a first profiled track 26 and a second fin 28 with a second profiled track 30. The first profiled track 26 and the second profiled track 30 are interlocked where the zipper 22 is introduced to the web 20. When being introduced to the web 20, the first fin 24 and the second fin 28 are continuous narrow films of material that are moving generally in the direction of the web 20. The zipper 22 can have a variety of configurations including, but not limited to, the two-piece design (as shown herein), a tamper-evident design, or a barrier-evident design, all of which are commonly known by the skilled artisan.

The web 20 and the zipper 22 are generally made of materials such as polyolefins. Nonlimiting examples of polyolefinic resins which may be used include low density polyethylenes, linear low density polyethylenes, high density polyethylenes (HDPE), medium density polyethylenes (MDPE), polypropylenes, plastomers, elastomers, ethylene vinyl acetates (EVA), ethyl methacrylates, polymethylpentene copolymers, polyisobutylenes, polyolefin ionomers, or combinations of these materials.

Figure 1B:
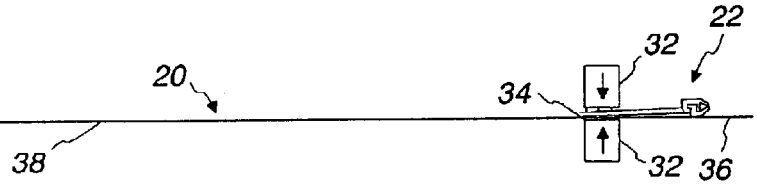

In FIG. 1B, the zipper 22 becomes attached to the web 20 by a pair of heat sealing structures 32 along a line 34 that separates the web 20 into a short section 36 and a long section 38. The first and second profiled tracks 26, 30 are adjacent to the short section 36 of the web 20 as the second fin 28 becomes integral with the web 20 along the line 34.

Figure 1C:
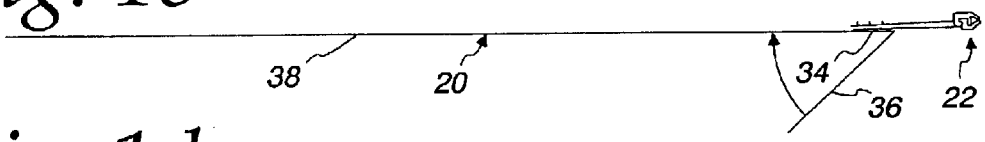

In FIG. 1C, the short section 36 of the web 20 is folded adjacent to the line 34 in a direction that is away from the zipper 22. Accordingly, the zipper 22 is substantially exposed so that unit operations can be applied to the zipper 22.

Figure 1D:
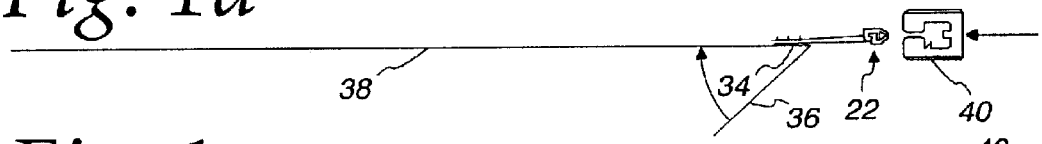

Unit operations are one or more steps performed on the zipper 22 to alter its configuration to be useful on a unitary package. For example, the first fin 24 and the second fin 28 are presealed at locations along the zipper 22 that correspond substantially to the width dimension of the final package that is to be produced from the web 20 and the zipper 22. The preseal is needed to seal the ends of the first fin 24 and the second fin 28 so that there is no leakage from the ends of the package. Additionally, a notch is developed through the first fin 24, first profiled track 26, the second fin 28, and the second profiled track 30 in the region where the preseal has occurred, as seen best in FIG. 2. The notch is needed for placing a slider 40 onto the zipper 22, as is shown in FIG. 1D. In addition, end clips may be placed on the zipper segments adjacent to the notches to restrict the movement of the slider 40 so that it cannot become removed from the zipper segments. The results of these unit operations are shown in more detail in FIG. 2, which illustrates the final package produced by the process illustrated in FIGS. 1A–1H.

Figure 1E:
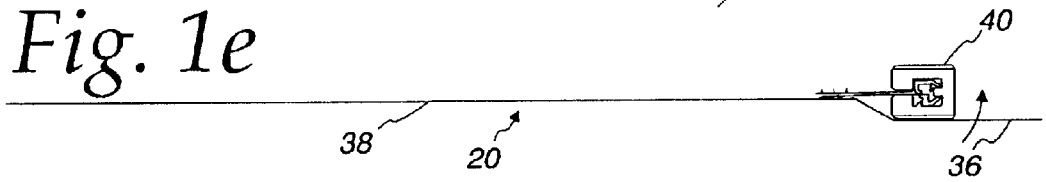
Figure 1F:
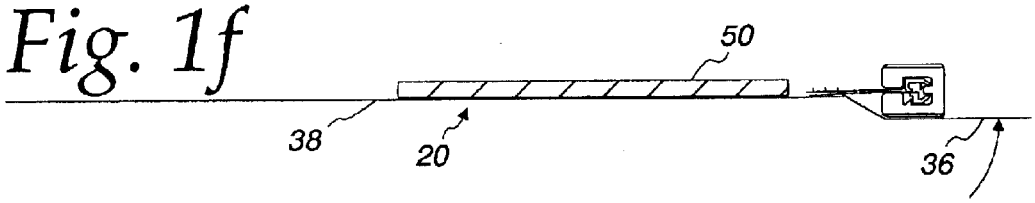

In FIG. 1E, the short section 36 of the web 20 is then folded back toward the zipper 22, preferably to a position that makes it parallel with the long section 38. The product 50 is then placed along the long section 38 of the web 20, as is shown in FIG. 1F. Because the web 20 is attached to the zipper 22 and the unit operations on the zipper 22 dictate the location where the web 20 will be cut to form individual packages, the product 50 is positioned on the web 20 between two adjacent preseals and their associated notches in the zipper 22.

Figure 1G:
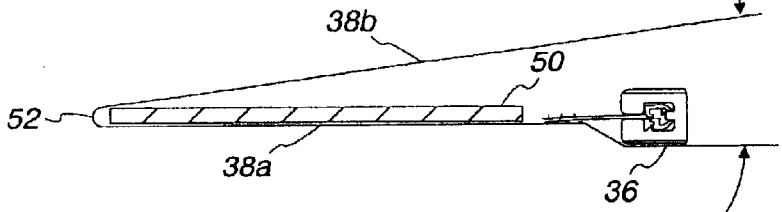

As shown in FIG. 1G, the long section 38 of the web 20 is then folded along the corner 51 that is just below the product 50 to produce a first package panel **38*a* and a second package panel 38*b*. Next, in FIG. 1H, heat sealing structures 52 contact the second package panel 38*b* to seal it to the first fin 24 of the zipper 22. Heat sealing structures 54 also seal the zipper 22 and the edge region of the short segment 36 to the second package panel 38*b*. Thus, the heat sealing structures 54 develop a header 56 for the individual packages. The sealing process for the heat sealing structures 52 can occur simultaneously with the sealing process for the heat sealing structures 54**, or at separate times.

Finally, the web 20 is sealed in a direction that is perpendicular to its movement such that the final seal which produces the side edges of the package is perpendicular to the seals produced by the heat sealing structures 52, 54. These side edge seals are then cut from the web 20 to develop the individual packages.

Figure 1H:
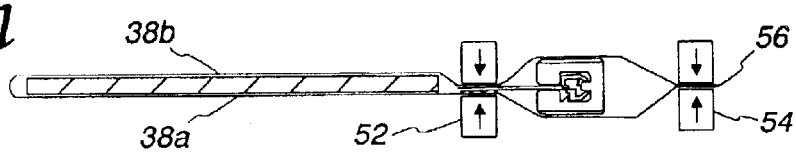
Figure 2:
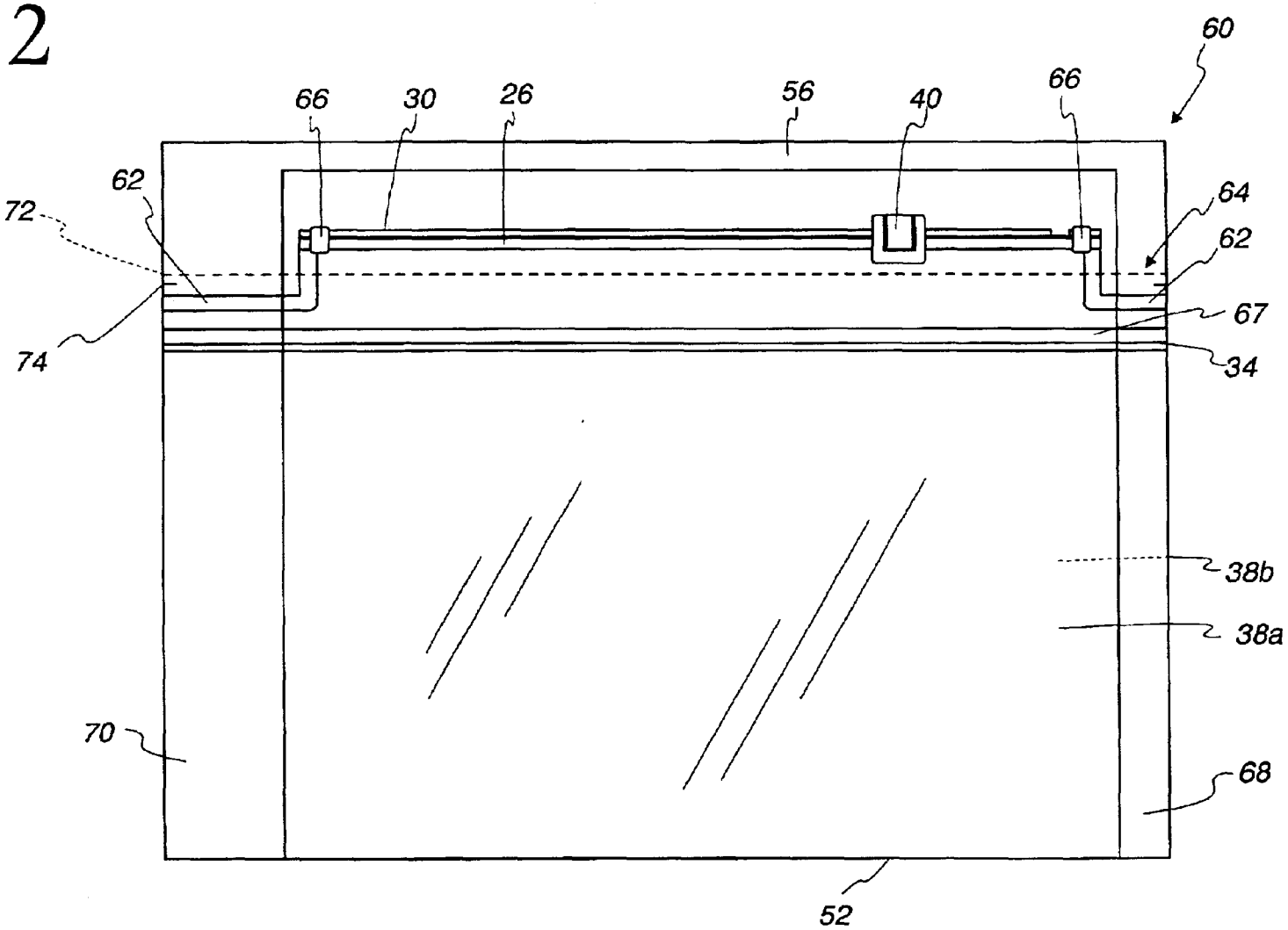
FIG. 2 illustrates the resulting package when the method of FIGS. 1A–1H is utilized.

FIG. 2 illustrates an individual package 60 that is produced by the process described with respect to FIGS. 1A–1H. Several of the resulting structures brought about by the unit operations on the zipper 22 within FIGS. 1A–1H are also illustrated. The zipper 22 of the package 60 contains a generally rectangular preseal 62 on each of its sides. Each of the preseals 62 represents a sealing of the first fin 28 to the second fin 24 of the zipper 22. After the preseals 62 are developed, a U-shaped notch 64 is cut into each of the preseals 62 so that the slider 40 can be inserted onto the first profiled track 26 that is interlocked with the second profiled track 30. The notch 64 is not shown in FIG. 2 as having a U-shape because half of the U-shape is allocated to the package 60, while the other half of the U-shape is allocated to the adjacent package, and the first and second package panels **38*a*, 38*b* are cut through the middle of the U-shape of the individual package 60. In addition, an end clip 66 may be placed at the end of the first and second profiled tracks 26, 30 directly adjacent to the preseals 62 to limit the movement of the slider 40**.

The header 56 at the top of package 60 extends entirely along the upper edge of the package 60. A seal 67 of the first package panel 38*a* to the first fin 28 of the zipper 22 and of the second package panel 38*b* to the second fin 24 of the zipper 22 extend along the line 34 that divides the short section 36 from the long section 38. Side seals 68, 70 define the outer portions of the package 60, and a cut along these side seals 68, 70 results in the outer edges of the package 60. Side seals 68, 70 merge into the header 56 at the top of the package 60.

The package 60 also contains a score line 72 that allows the user to remove the upper portion of the package 60 to expose the zipper 22 and its associated slider 40. To facilitate tearing of the package 60 along the score line 72, a small tear 74 may be placed at the edges of the package 60 directly adjacent to the score line 72.

In summary, the end result of the process described with respect to FIGS. 1A–1H does not require that the slider 40 be attached to the zipper 22 before the zipper 22 is attached to the web 20. This is accomplished by folding the web 20 to expose the zipper 22 so that the unit operations (e.g., presealing, notching, applying end clips, and/or applying slider, etc.) for each package can be performed on the zipper 22 while it is attached to the web 20.

Figure 3A:
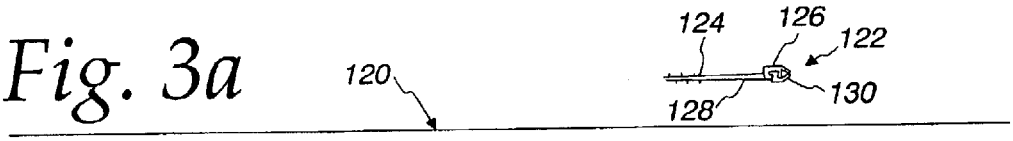
FIGS. 3A–3I illustrate another method of a form, fill, and seal process according to the present invention.
Figure 3B:
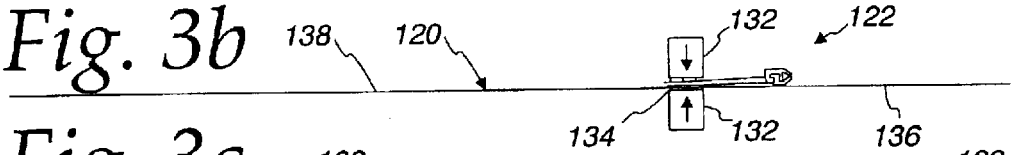

FIGS. 3A–3I illustrate an alternative process for developing a package where all of the reference numerals are the same, except they are denoted as 100 series reference numerals to designate similar structures. As shown in FIGS. 3A and 3B, a web 120 is moving in a generally horizontal direction at a location that is close in proximity to a similarly moving zipper 122. The zipper 122 is attached to the web 120 along a line 134 that is substantially parallel to the edges of the web 120. The line 134 defines a short section 136 of the web 120 and a long section 138 of the web 120.

Figure 3C:
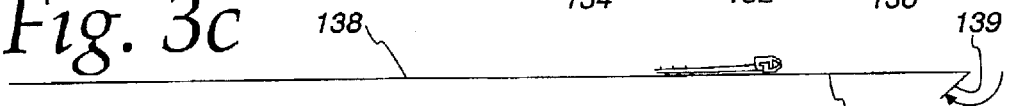
Figure 3D:
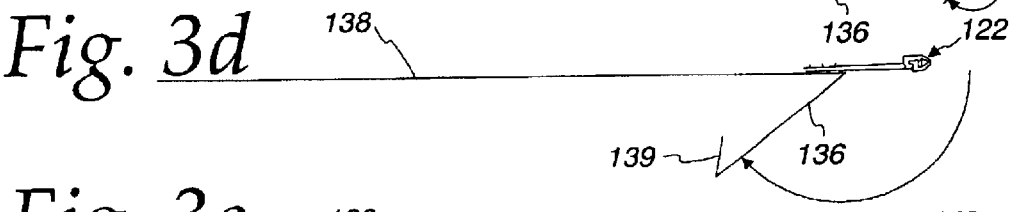
Figure 3E:
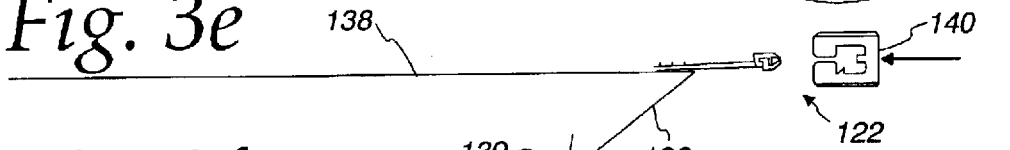

In FIG. 3C, a final hem 139 is made by folding the edge of the short section 136. Next, as shown in FIG. 3D, the short section 136 is then folded away from the zipper 122 to expose the zipper 122 for the various types of unit operations that may be performed on the zipper 122. For example, as shown in FIG. 3E, a slider 140 is placed along the zipper 122. Additionally, because the short section 136 is then folded back to expose the zipper 122, it is possible to also preseal the zipper 122, notch the region of the preseal of the zipper 122, and apply end clips, as described above with respect to FIGS. 1A–2.

Figure 3F:
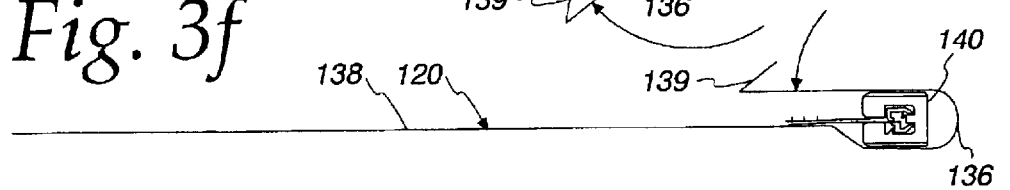
Figure 3G:
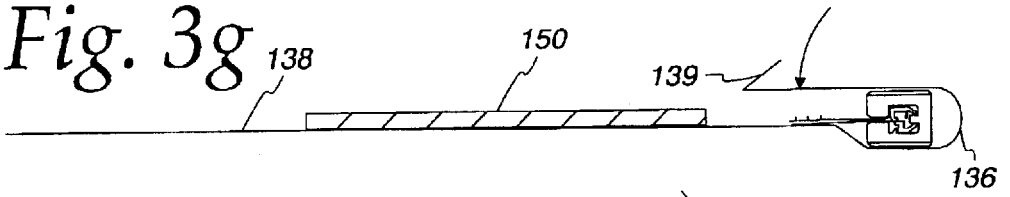
Figure 3H:
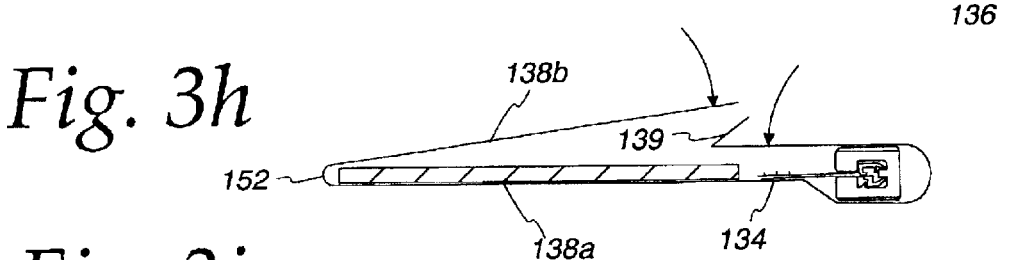

As shown in FIG. 3F, the short section 136 is then folded back over the slider 140 such that the final hem 139 is in a position to be sealed. The product 150 is then placed on the long section 138, as shown in FIG. 3G, and the long section 138 of the web 120 is folded at a corner 151 to produce a first package panel 138*a* and a second package panel 138*b*, as shown in FIG. 3H.

Figure 3I:
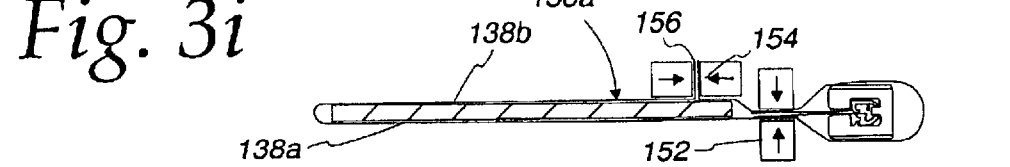

As shown in FIG. 3I, a region of the short segment 136 is then heat-sealed to the second fin 124 at a point that is adjacent to the line 134 with a pair of heat sealing structures 152. This sealing creates a pocket in which the zipper 122 and the zipper 140 reside. The terminal edge of the second package panel 138*b* is sealed to the final hem 139 with a pair of heat sealing structures 154 to form a flange seal 156. The heat sealing structures 152, 154 can be utilized simultaneously or at different times.

Figure 4:
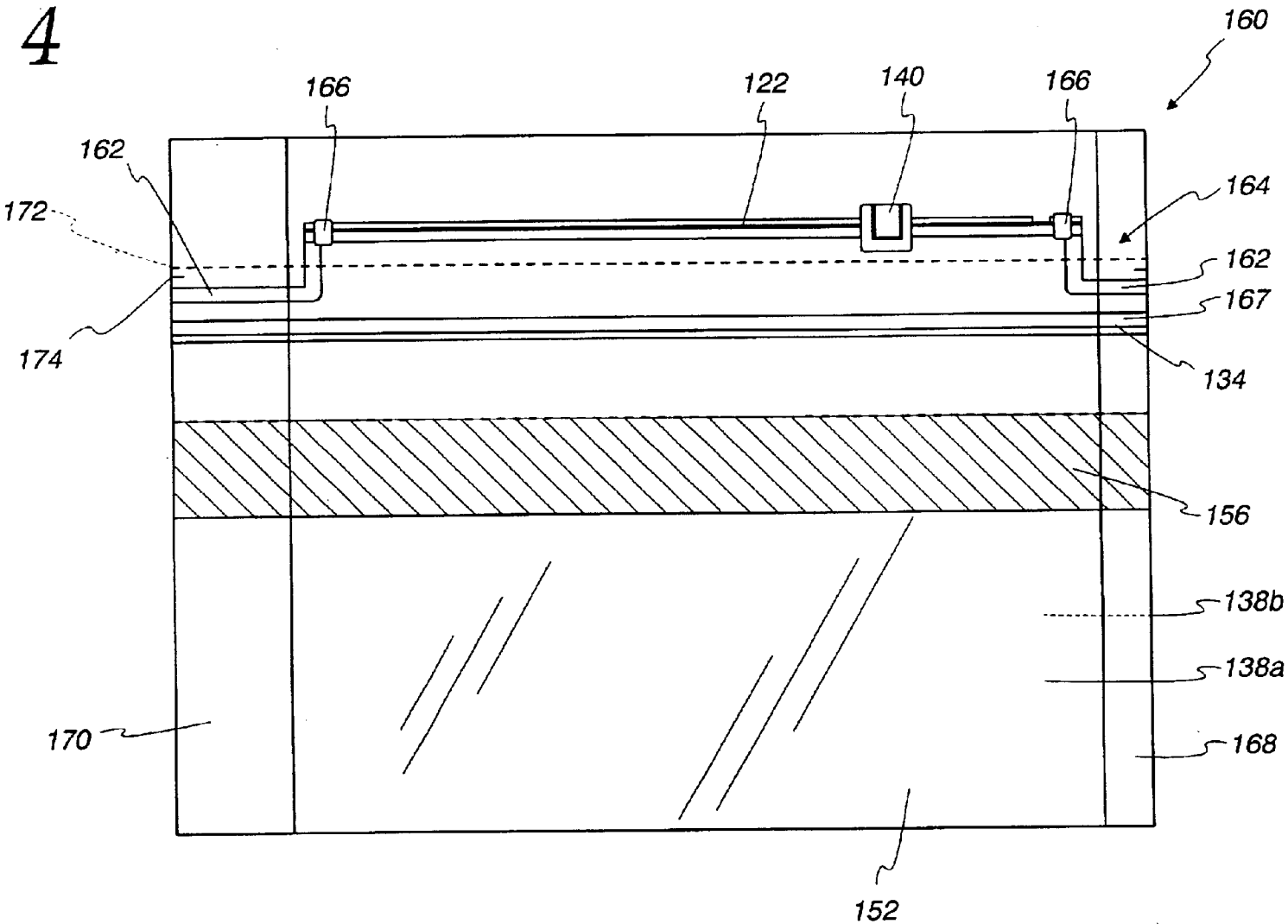
FIG. 4 illustrates the resulting package when the method of FIGS. 3A–3I is utilized.

FIG. 4 is similar to FIG. 2, except the reference numerals are now denoted as 100 series reference numerals. The primary difference between FIGS. 2 and 4 is that there is no header 56 at the top of the package 160 of FIG. 4, while there is the header 56 in the package 60 of FIG. 2. Instead, the final hem 139 on the short segment 136 has been sealed at an intermediate part of the package 160 to form the flange seal 156. Like the previous package, a score line 172 is located at the upper part of the package 160 to help the consumer remove the top portion of the package 160 to expose the zipper 122 and its associated slider 140. A small tear initiation 174 is located adjacent to the score line 172 to assist the consumer in starting the tear along the score line 172.

Figure 5A:
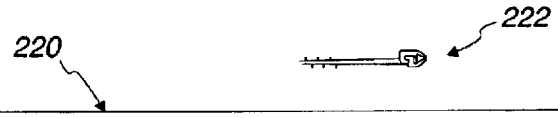
FIGS. 5A–5I illustrate yet another method of a form, fill, and seal process according to the present invention.
Figure 5B:
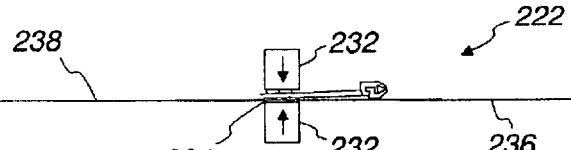
Figure 5C:
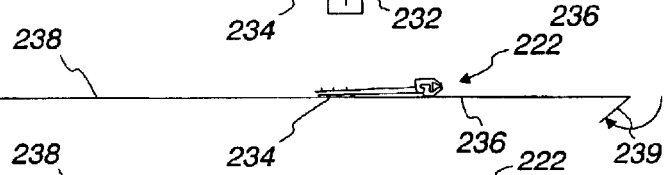
Figure 5D:
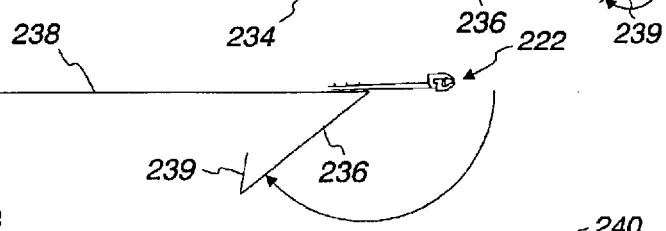
Figure 5E:
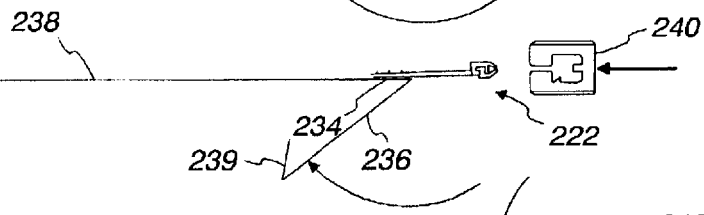

FIGS. 5A–5I illustrate a process similar to the process described above with respect to FIGS. 1A–4. A web of material 220 and a zipper 222 are sealed to each other along a line 234 by heat sealing structures 232. This forms a short section 236 and a long section 238 of the web 220. An edge portion of the short section 236 is then folded downward to form a hem 239 and the entire short section 236 is folded away from the zipper 222. Various unit operations, such as presealing, notching, adding a slider 240, and/or adding end terminations, are then performed on the zipper 222, which is now exposed due to folding of the short section 236, as shown in FIG. 5E.

Figure 5F:
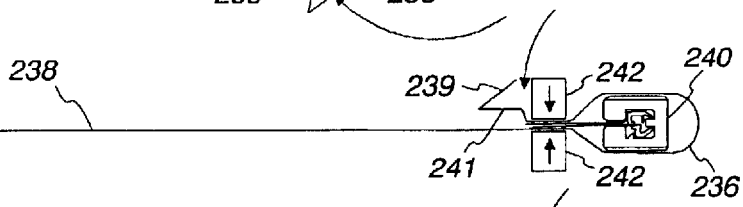
Figure 5G:
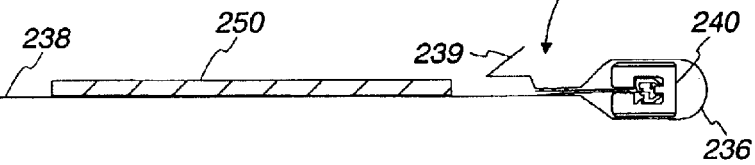
Figure 5H:
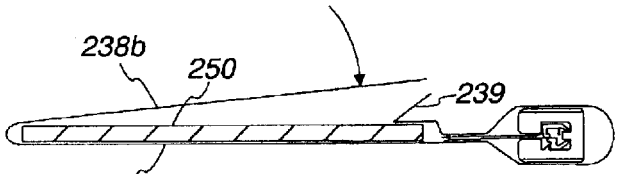
Figure 5I:
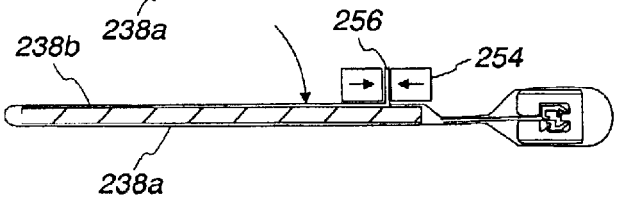

Next, the short section 236 is folded back around the zipper 222 and the slider 240 and is sealed to the zipper 222 with a pair of heat sealing structures 242, as shown in FIG. 5F. Accordingly, after sealing, the short section 236 includes a lateral portion 241 that is generally horizontal to the opposing long section 238 and forms a part of the enclosure in which the product 250 is placed. Flat supporting structures can be used to keep the lateral portion 241 spaced away from the long section 238, such that the product 250 may slide, if desired, under the lateral portion 241. The long section 238 is then wrapped around the product 250 to form a first package panel 238*a* and a second package panel 238*b*. The free end portion of the long section 238 is then sealed to the hem 239 with a pair of heat sealing structures 254 to form a flange 256. Accordingly, the primary difference between the processes described with respect to FIGS. 3A–3I and 5A–5I is that, in the process in FIGS. 5A–5I, the short section 236 is sealed to the zipper prior to the product 250 being added to the long section 238 of the web 220.

Figure 6:
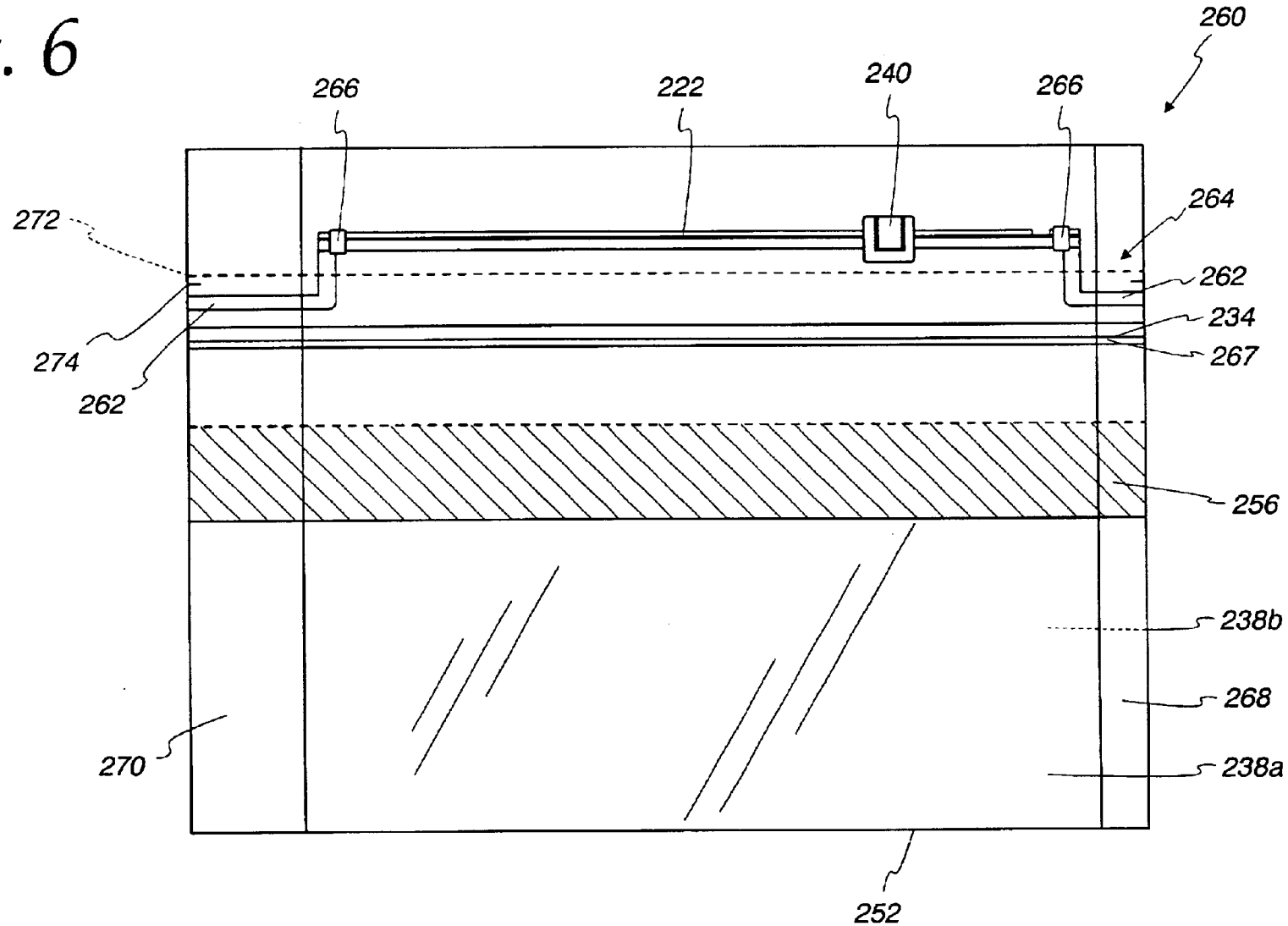
FIG. 6 illustrates the resulting package when the method of FIGS. 5A–5I is utilized.

FIG. 6 illustrates the package 260 that is brought about by the process in FIGS. 5A–5I. The package 260 is identical to the package 160 of FIG. 4 and the corresponding reference numerals in FIG. 6 are the same as those in FIG. 4, except the reference numerals are now denoted as 200 series reference numerals.

Figure 7A:
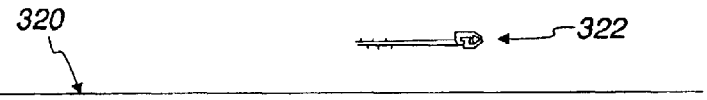
FIGS. 7A–7I illustrate a further method of a form, fill, and seal process according to the present invention.
Figure 7B:
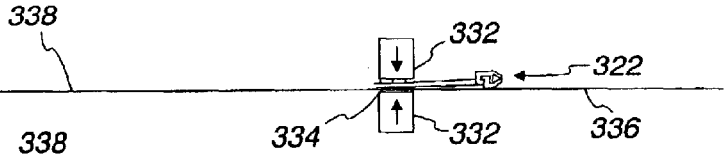
Figure 7C:
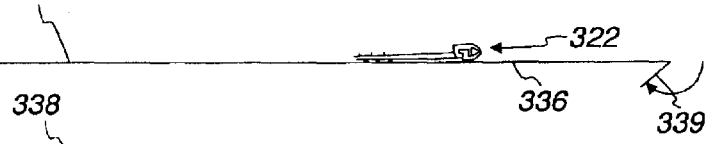
Figure 7D:
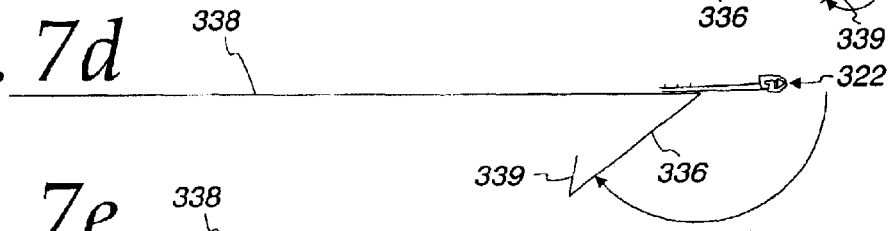

FIGS. 7A–7I illustrate a process that is similar to the process described with respect to FIGS. 3A–3I and 5A–5I. A web of material 320 and a zipper 322 are sealed along a line 334 by a pair of heat sealing structures 332. The line 334 divides the web 320 into a short section 336 and a long section 338. The end portion of the short section 336 is folded back to develop a hem 339, and the entire short section 336 is folded back away from the zipper 322, as shown in FIG. 7D.

Figure 7E:
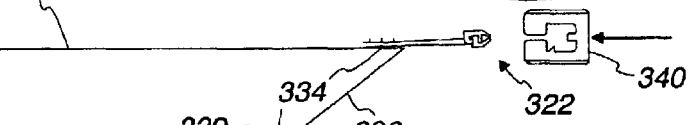
Figure 7F:
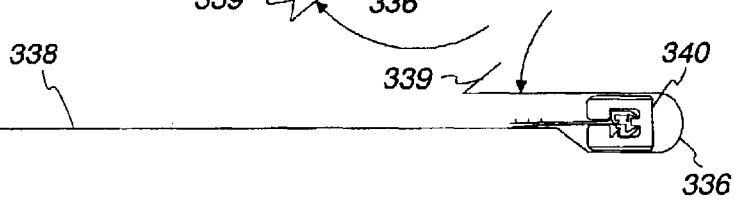
Figure 7G:
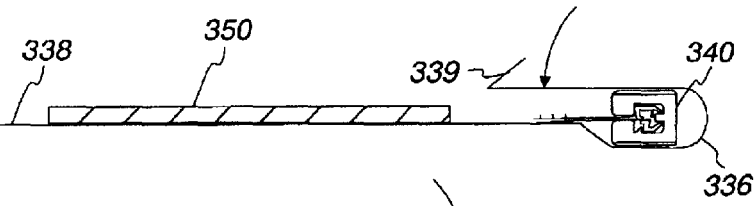
Figure 7H:
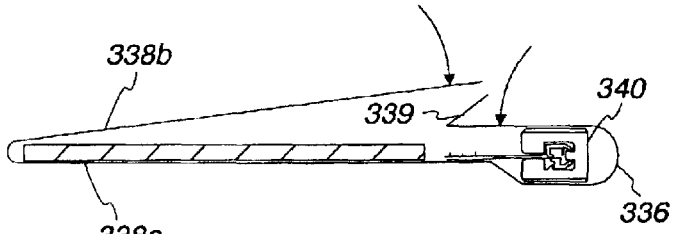
Figure 7I:
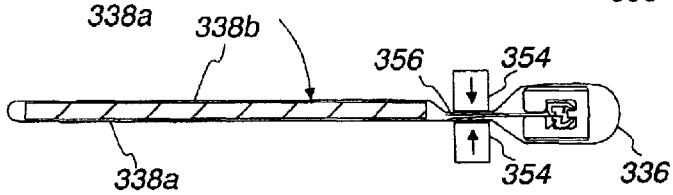

Now that the zipper 322 is exposed, the unit operations that are required to be performed on the zipper 322 can be accomplished. This includes presealing the zipper 322, placing a notch in the presealing, attaching a slider 340 to the zipper 322 (as shown in FIG. 7E), and/or possibly adding end clips. The short section 336 is then folded over the zipper 322 and the slider 340. The product 350 is added to the long section 338, and the long section 338 is folded over the product 350 to develop a first package panel 338*a* and a second package panel 338*b*, as shown in FIG. 7H. Finally, a free end portion of the long section 338 is sealed to the hem 339 to form a flange 356. At the same time, the short section 336 is sealed to a first fin 324 of the zipper 322. This simultaneous sealing process is performed by a pair of heat sealing structures 354, as shown in FIG. 7I.

Figure 8:
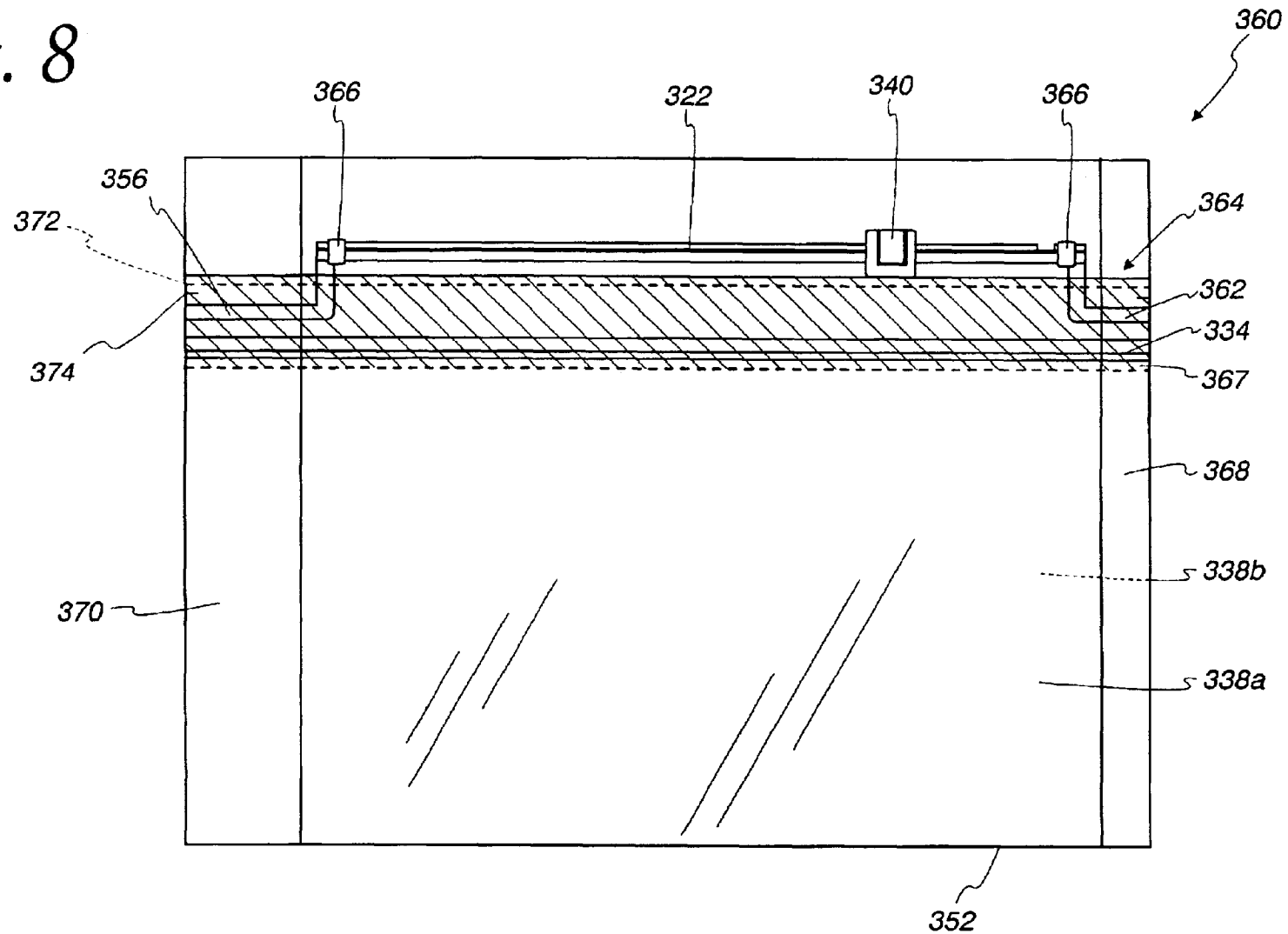
FIG. 8 illustrates the resulting package when the method of FIGS. 7A–7I is utilized.

FIG. 8 illustrates a package 360 developed by the process in FIGS. 7A–7I. All reference numerals are the same as those described for the previous packages in FIGS. 4 and 6, except the reference numerals are now denoted as 300 series reference numerals. The primary difference between the package 360 and the packages of the previous embodiments is that the flange 356 is directly adjacent to the line 334 because the flange 356 is formed by a heating process that is simultaneous with the sealing of the short section 336 to the first fin 324 of the zipper 322. Consequently, the flange 356 is closer to the top edge of the package 360 than the flanges 156, 256 in FIGS. 4 and 6.

Figure 9A:
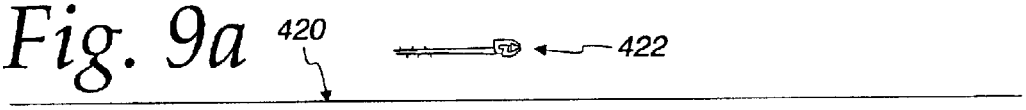
FIGS. 9A–9H illustrate another method of a form, fill, and seal process according to the present invention.
Figure 9B:
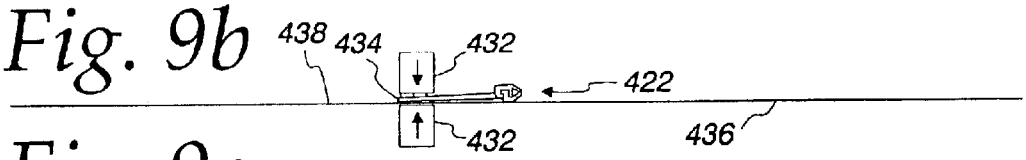
Figure 9C:
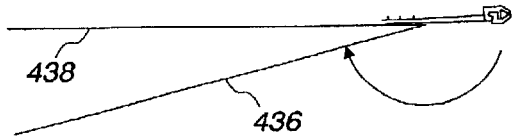
Figure 9D:
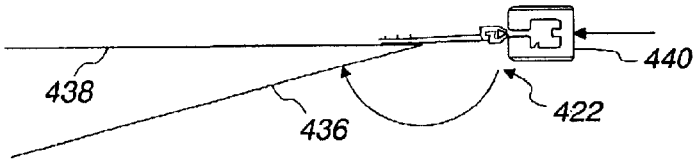

FIGS. 9A–9H illustrate another process according to the present invention in which a web of material 420 and a zipper 422 are attached by a pair of heat sealing structures 432 along a line 434 dividing the web 420 into a first section 436 and a second section 438. Next, the first section 436 is folded away from the zipper 422 so as to be adjacent to the second section 438. With the zipper 422 exposed, the various unit operations described above can be performed on the zipper 422. This includes, for example, the addition of a slider 440 to the zipper 422, as shown in FIG. 9D.

Figure 9E:
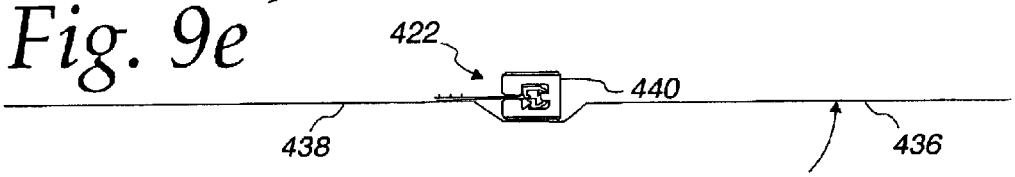
Figure 9F:
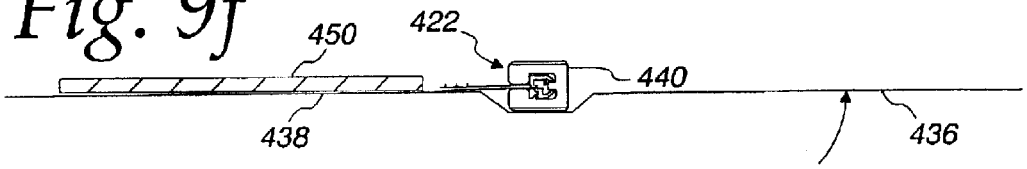
Figure 9G:
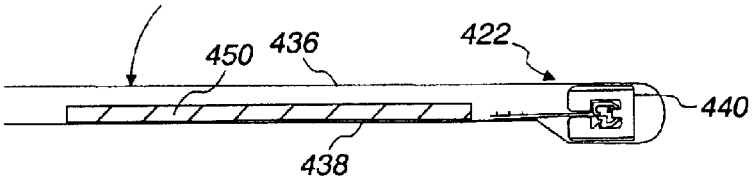
Figure 9H:
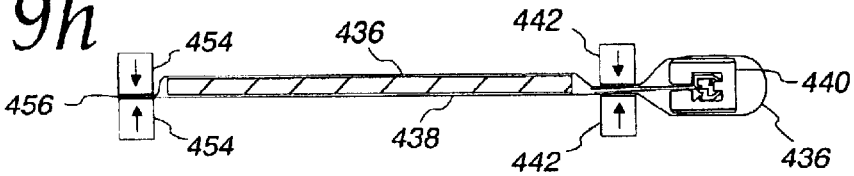

Once the unit operations are performed on the slider 422, the first section 436 is folded back to a position that is away from the second section 438. Preferably, the first section 436 is returned to a position that is generally coplanar with the second section 438, as shown in FIG. 9E. The product 450 is placed on the second section 438, as shown in FIG. 9F. The first section 436 is then wrapped around the zipper 422 and the slider 440, such that the first section 436 is in contact with the product 450, as shown in FIG. 9G. The first section 436 is then attached to the slider 422 by a pair of heat sealing structures 442. And, a header 456 (or bottom flange) is formed at the bottom of the package by a pair of heat sealing structures 454 that seal the first section 436 to the second section 438. These two heat sealing steps can be performed at different times or can be performed simultaneously. For example, a single heating structure on the top of the package having two heat sealing elements, one at the bottom of the package and the other at the top of the package, can interact with a single heating structure on the underside of the package which has two similarly positioned heat sealing structures.

Figure 10:
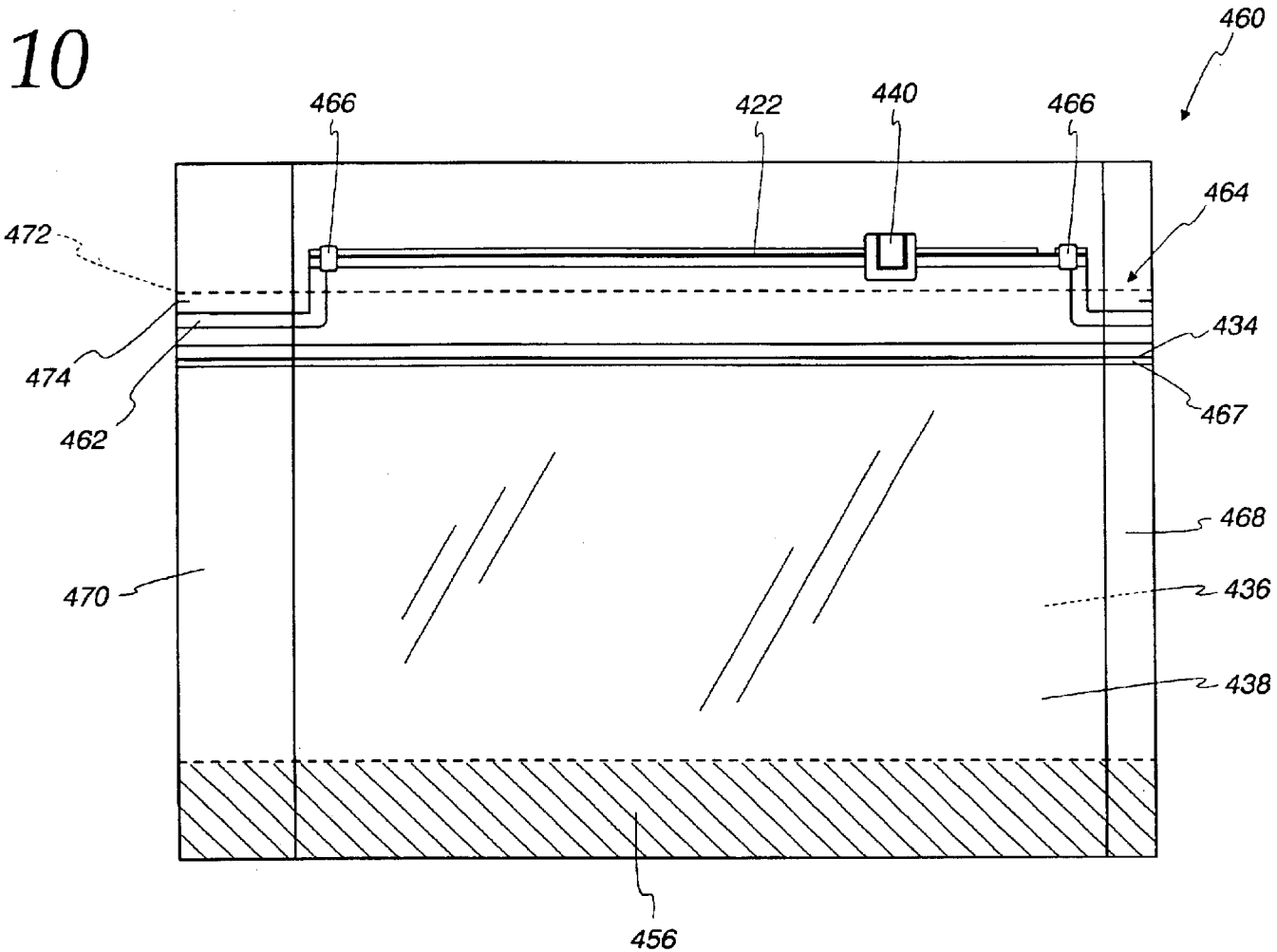
FIG. 10 illustrates the resulting package when the method of FIGS. 9A–9H is utilized.

FIG. 10 illustrates a package 460 created by the process disclosed in FIGS. 9A–9H. The package 460 includes the zipper 422 and the slider 440 located at its upper portion. There is no seal at the top edge of the package 460 since the first section 436 has been folded over the zipper 422 and brought into contact with the second section 438 at the header 456 by the pair of heat sealing structures 454. Thus, this seal between the first section 436 and the second section 438 is located at the bottom of the package 460. Additionally, the first section 436 and the second section 438 are attached to the zipper 422 along the line 434 by a seal 467 created by the heat sealing structures 442. The package 460 includes side seals 468, 470 that extend perpendicular to the header 456 at the bottom of the package 460.

The unit operations performed on the zipper 422 are evident in the package 460. For example, a preseal 462 is located on either side of the package 460. As described above, the preseal 462, if viewed when a plurality of packages 460 are aligned side-by-side, has a U-shape where one part of the U-shape is allocated to one package and the other part of the U-shape is allocated to the adjacent package. As such, when viewing one package by itself, like the package 460, the U-shaped notch in the preseal 462 gives the preseal 462 an L-shape. An end clip 466 is located at the end of the interlocking portions of the zipper 422 to inhibit the progress of the slider 440 beyond those points defined by the end clips 466.

Figure 11A:
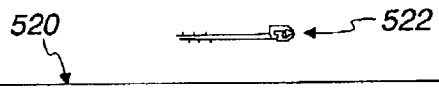
FIGS. 11A–11H illustrate yet a further method of a form, fill, and seal process according to the present invention.
Figure 11B:
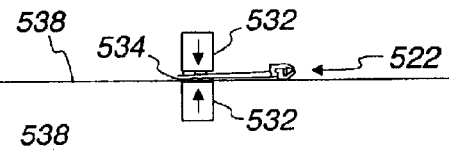
Figure 11C:
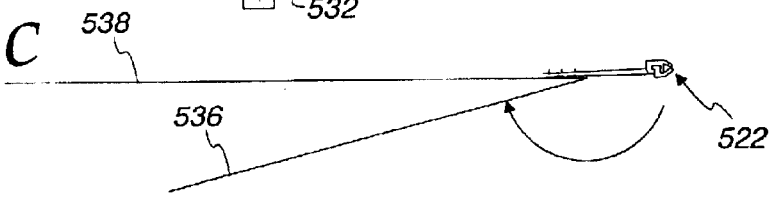
Figure 11D:
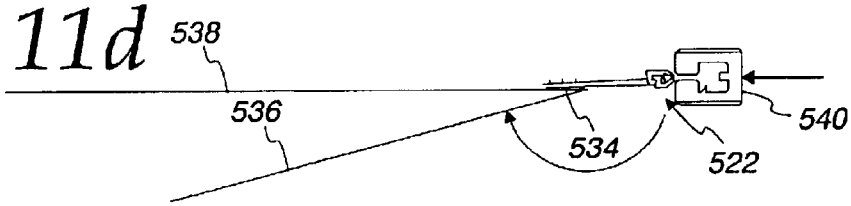
Figure 11E:
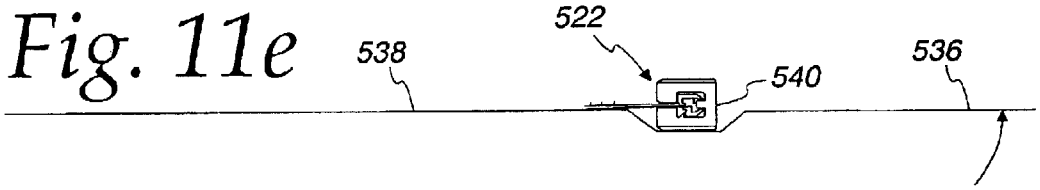

FIGS. 11A–11H describe a process that is similar to the process in FIGS. 3A–3I. A web of material 520 and a slider 522 are attached by a pair of heat sealing structures 532 along a line 534 in a central portion of the web 520 that defines a first section 536 and a second section 538 of the web 520. Once the slider 522 is attached to the web 520, the first section 536 is folded back toward the second section 538. Next, the unit operations are performed on the exposed zipper 522, such as the addition of the slider 540, as shown in FIG. 11D. The first section 536 is then folded back away from the second section 538, preferably to a location that is generally coplanar with the second section 538, as shown in FIG. 11E.

Figure 11F:
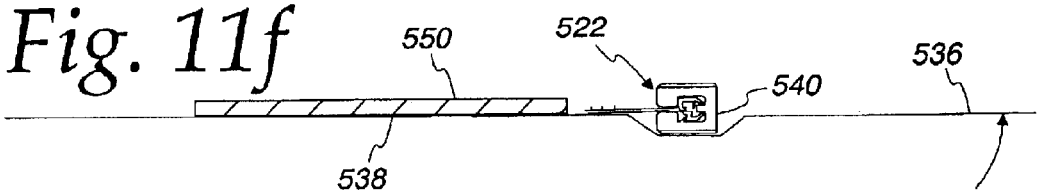
Figure 11G:
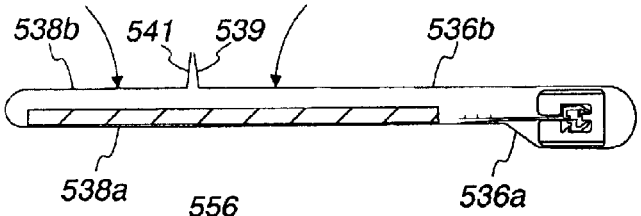

The product 550 is placed on the second section 538, as shown in FIG. 11F. The first section 536 is then folded around the zipper 522 such that a first portion 536*a* forms a pouch around the zipper 522, while a second portion 536*b* is positioned against the product 550. The second section 538 is folded around the bottom of the product 550 such that a first portion 538*a* is against the bottom side of the product 550 and a second portion 538*b* is the top side of the product 550, as shown in FIG. 11G.

Figure 11H:
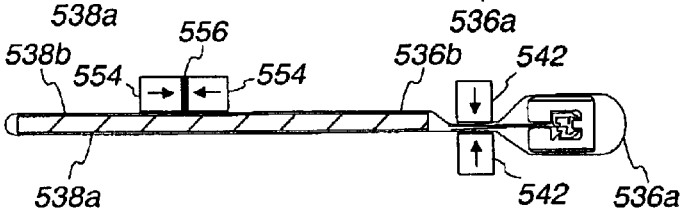

A hem 539 is located at the edge of the first section 536 of the web 520 and a hem 541 is formed at the edge of the second section 538 of the web 520. The hems 539, 541 are then sealed by a pair of heat sealing structures 554 to form a flange 556, while the first section 536 is attached to the first fin 524 of the zipper 522 by a pair of heat sealing structures 542, as shown in FIG. 11H.

Figure 12:
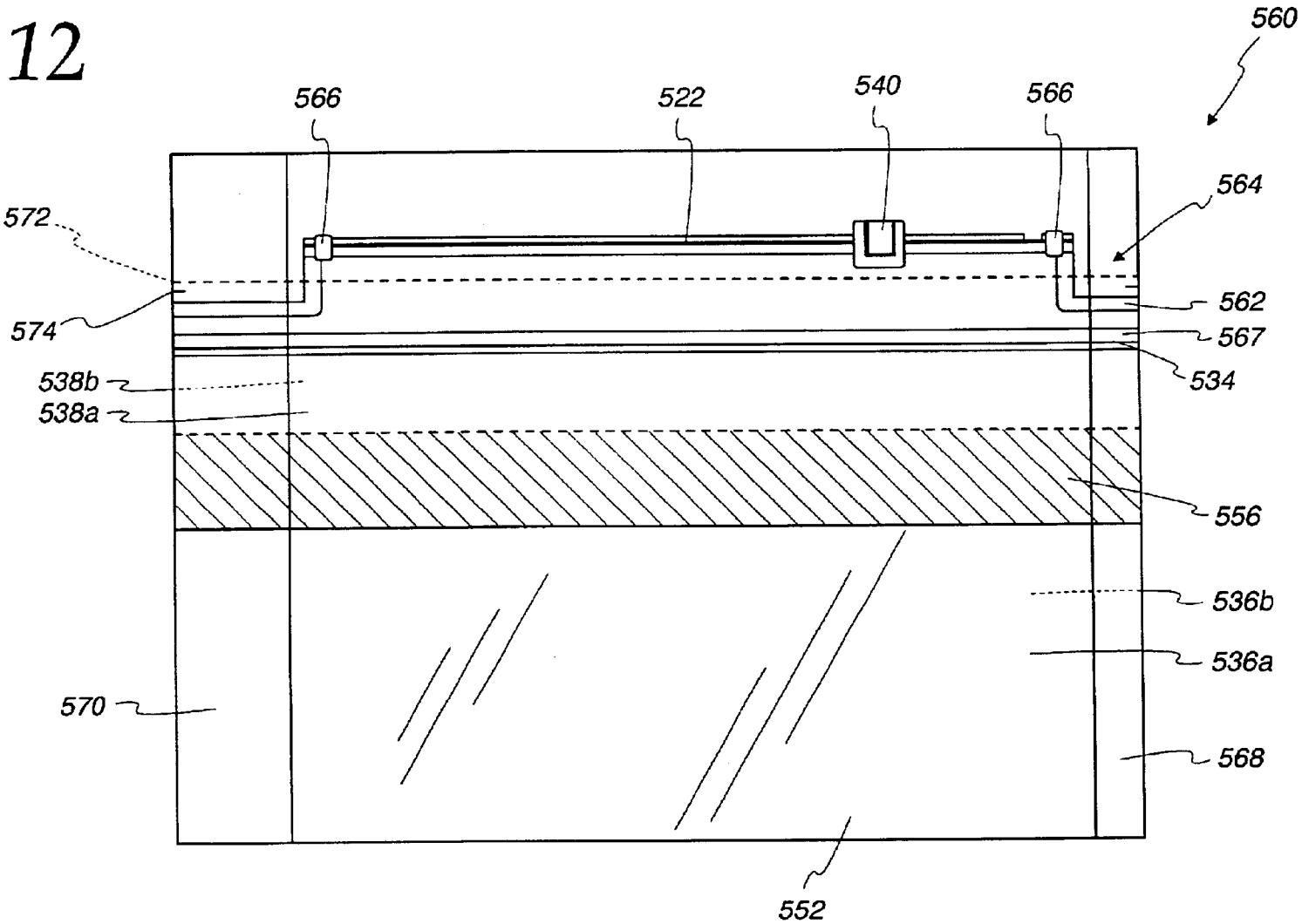
FIG. 12 illustrates the resulting package when the method of FIGS. 11A–11H is utilized.

FIG. 12 illustrates a package 560 created by the process described in FIGS. 11A–11H. The reference numerals are the same as the packages previously described, except the reference numerals are now denoted as 500 series reference numerals. The flange 556 is located in the middle of the package a short distance away from the seal 567 of the zipper 522 to the web 520.

Figure 13A:
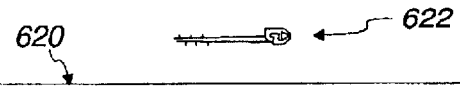
FIGS. 13A–13I illustrate another alternative method of a form, fill, and seal process according to the present invention.
Figure 13B:
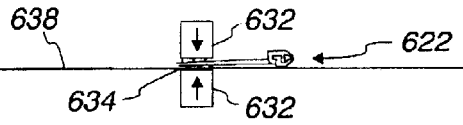
Figure 13C:
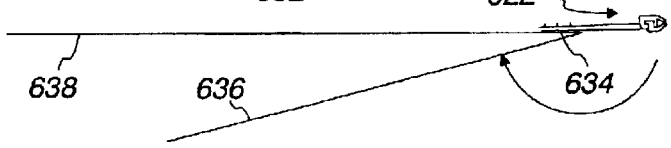
Figure 13D:
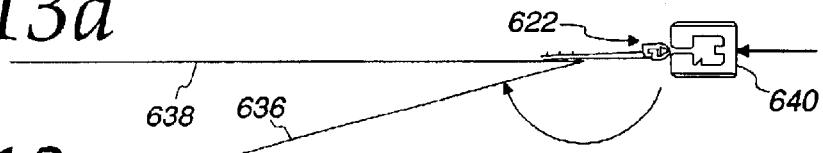
Figure 13E:
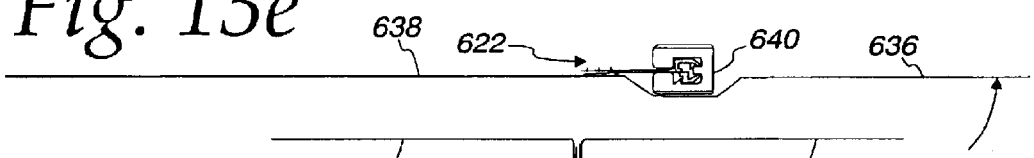
Figure 13F:
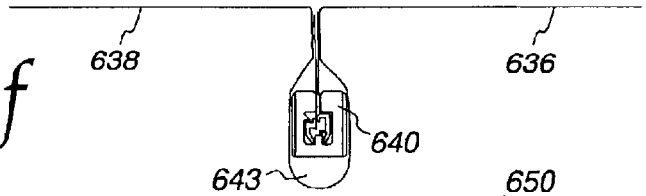

FIGS. 13A–13I illustrate yet a further process for forming a package according to the present invention. A web of material 620 and a zipper 622 are attached along a line 634 by a pair of heat sealing structures 632. The line 634 divides the web 622 into a first section 636 and a second section 638. The first section 636 is then folded away from the zipper 622 to expose the zipper 622 (FIG. 13C) for various unit operations that may include any of the previously mentioned unit operations, such as adding a slider 640, as shown in FIG. 13D. Once the unit operations on the zipper 622 have been performed, the first section 636 is then folded back toward the slider 622. Preferably, the first section 636 and the second section 638 are generally coplanar after the first section 636 has been folded back, as shown in FIG. 13E.

Figure 13G:
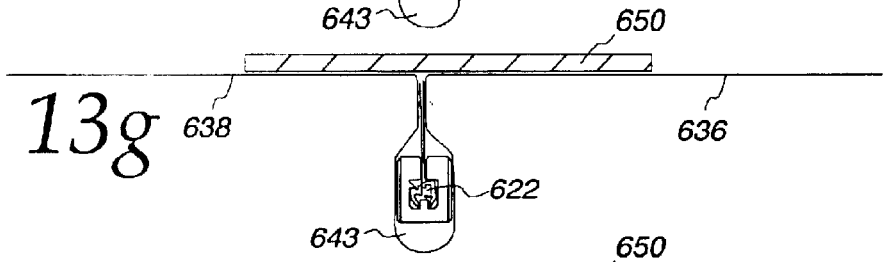
Figure 13H:
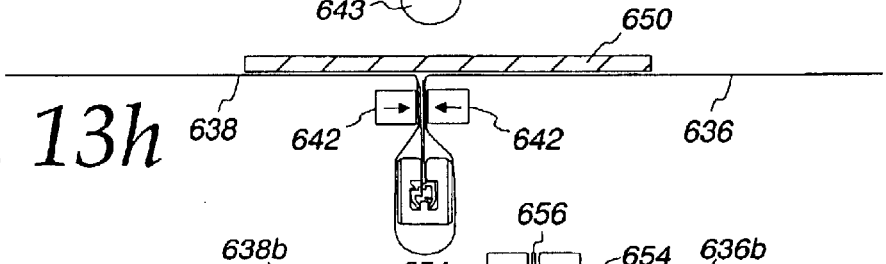

The zipper 622 and the slider 640 are then rotated downwardly into a plane that is transverse to a plane in which either the first section 636 or the second section 638 is located. Preferably, the zipper 622 and the slider 640 are rotated to a position such that they are generally perpendicular to the plane in which both the first section 636 and the second section 638 reside. By rotating the zipper 622 in this fashion, a pocket 643 is formed around the zipper 622 and the slider 640 from the material that is part of the first section 636. The product 650 is then placed on the first section 636 and the second section 638, as shown in FIG. 13G.

Figure 13I:
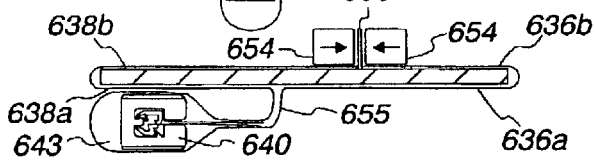

A pair of heat sealing structures 642 seal the first section 636 to the unsealed fin of the zipper 622. The first and second sections 636, 638 are then further folded around the product 650 and sealed at a flange 656 by a pair of heat sealing structures 654, as shown in FIG. 13I. In doing so, the first section 636 has a front portion 636*a* and a back portion 636*b*, while the second section 638 has a front portion 638*a* and a back portion 638*b*. A stem 655 is formed from the first and second sections 636, 638 between the zipper 622 and the product 650. The pocket 643 is rotated such that the pocket 643 resides against the front portion 638*a* of the second section 638.

Figure 14:
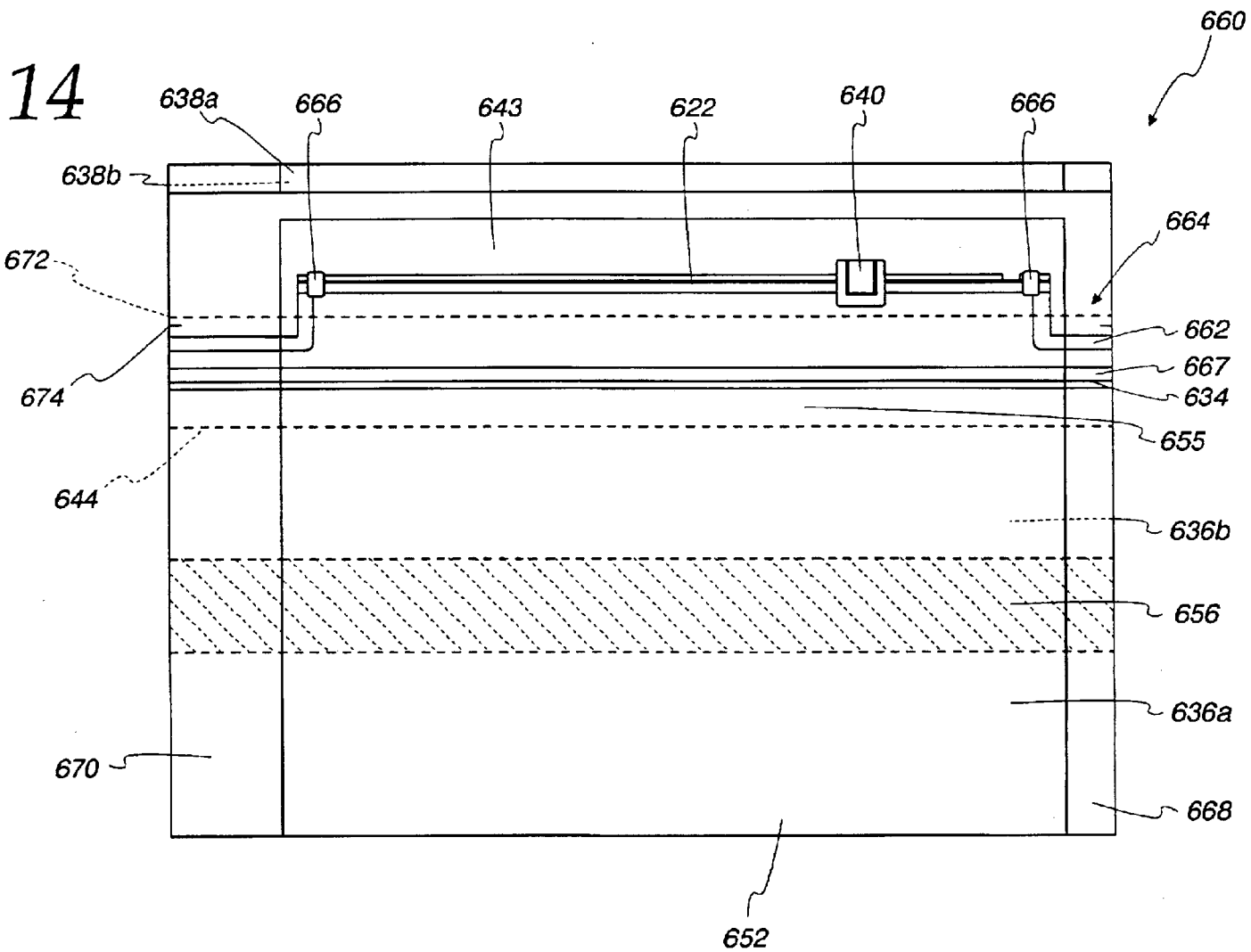
FIG. 14 illustrates the resulting package when the method of FIGS. 13A–13I is utilized.

FIG. 14 illustrates a package 660 developed by the process described with respect to FIGS. 13A–13I. The package 660 is similar to the previous packages with the same reference numerals, except the reference numerals are now denoted as 600 series reference numerals. FIG. 14 is a view taken from the side of the package 660 on which the pocket 643 resides. The dashed line 644 in the center of the package represents bending at the stem 655 as it transitions into the pocket 643. The front and back portions 638*a*, 638*b* of the second section 638 are above the pocket 643 and the front and back portions 636*a*, 636*b* of the first section 636 are below the flange 656. The flange 656 is shown on the back of the package 660.

FIGS. 15A–15J illustrate an alternative embodiment of the process of FIG. 14 wherein a web 720 and a sipper 722 are traveling in the same direction and one fin of the zipper 722 is attached to the web 720 via one or more heat sealing structures 732 along a line 734. The line 734 defines a first section 736 and a second section 738 of the web 720.

Figures 15A, 15B, 15C, 15D, 15E, 15F, 15G, 15H, 15I, 15J:
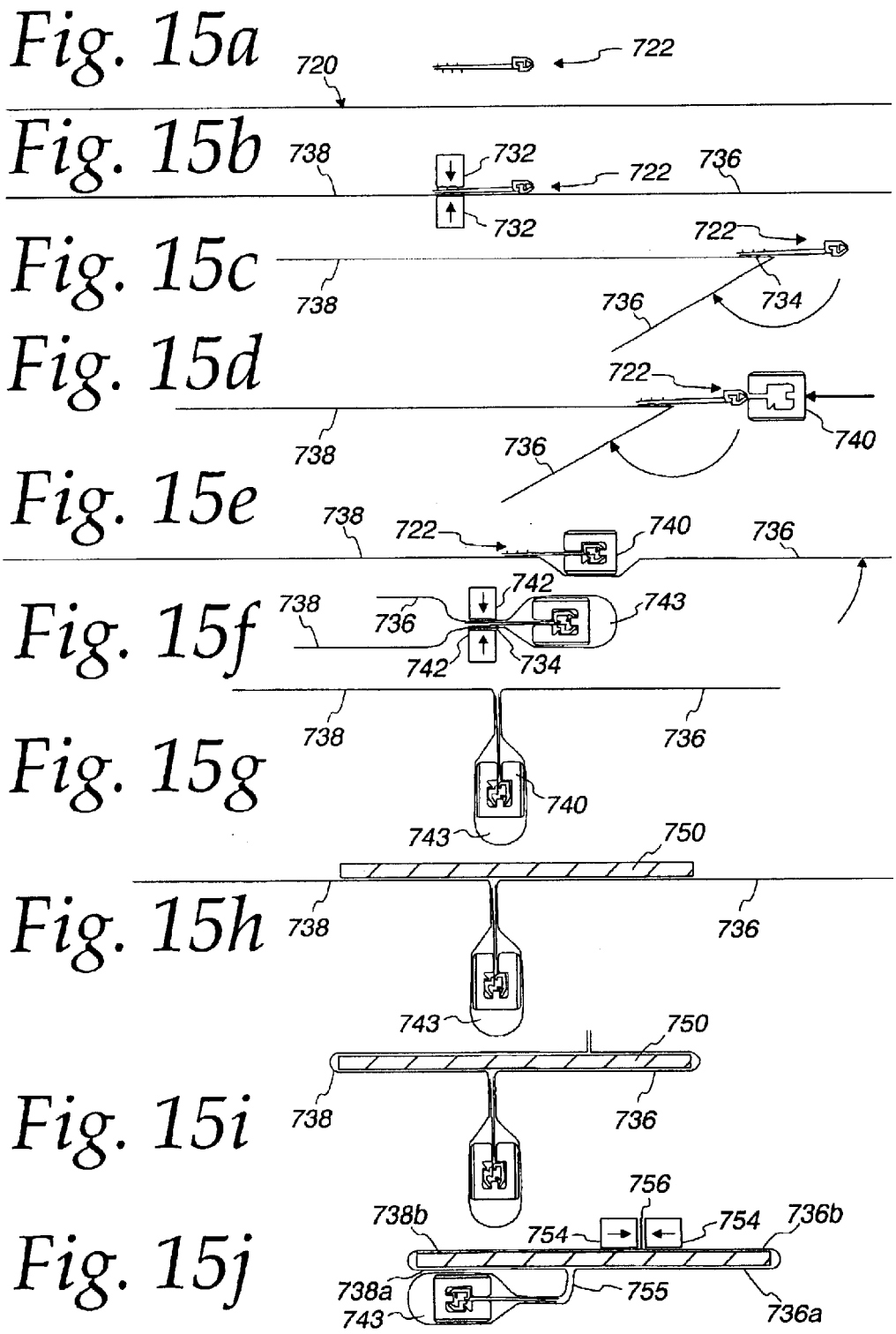
FIGS. 15A–15J illustrate another alternative method of a form, fill, and seal process according to the present invention.

As shown in FIG. 15C, the first section is folded back to expose the zipper 722 for unit operations, which may include the addition of a slider 740, as shown in FIG. 15D. After the unit operations have been performed, the first section 736 is then folded upwardly, preferably to a point that is generally coplanar with the second section 738, as shown in FIG. 15E.

The first section 736 is wrapped around the zipper 734 and the slider 740, and is then attached to the top fin of the zipper 722 via one or more heat sealing structures 742. This wrapping process develops a pocket 743 around the slider 722. The pocket 743 is then folded downwardly such that it is transverse, and preferably perpendicular, to the first section 736 and the second section 738.

The product 750 is then placed on one or both of the first and second sections 736, 738. The first and second sections 736 and 738 are then folded over the product 750 and sealed via heat sealing structures 754 to develop a flange 756. The first section 736 then has a front portion 736*a* and a back portion 736*b*. Likewise, the second section 738 then has a front portion 738*a* and a back portion 738*b*. The pocket 743, which has a stem 755 formed by the heat sealing structures 742, is folded toward the product 750, as shown in FIG. 5J. The final package produced by the process in FIGS. 15A–15J is nearly identical to that package shown in FIG. 14.

Figure 16:
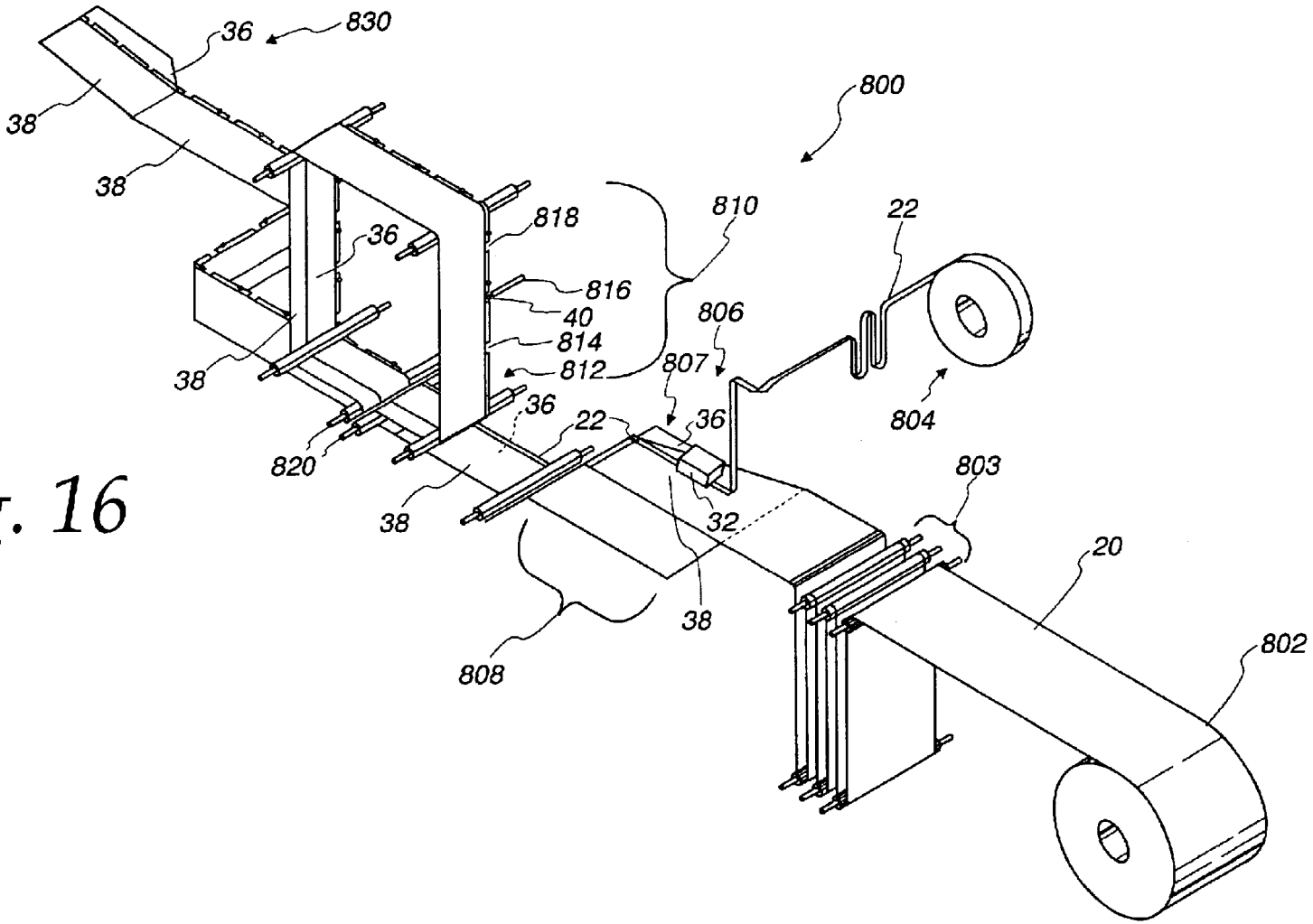
FIG. 16 illustrates one embodiment of the movement of the web of material and the associated zipper that is used to expose the zipper for unit operations that are performed on the zipper.

FIG. 16 illustrates one embodiment of a machine 800 that may be used to attach the zipper 22 to the web of material 20 and perform unit operations on the zipper 22, as described in the previous embodiments. While FIG. 16 describes the structures in conjunction with the web 20 and zipper 22 of FIGS. 1A–1H, this process of exposing the zipper 22 applies to each of the processes mentioned in FIGS. 1A–15J.

The web 20 is wound on a roll 802 which feeds the system with the web material. Similarly, the zipper 22 is provided to the system through a drum 804, around which the zipper 22 is wound with its interlocking features in an interlocked position. At attachment station 806, one of the fins 28 (FIGS. 1A–1H) of the zipper 22 is attached to the web 20 with the heat sealing structures 32. This sealing takes place along the line 34 (FIGS. 1A–1H) that is generally parallel to the edges of the web 20. This line 34 separates the short section 36 of the web 20 from the long section 38 of the web 20. It should be noted that the zipper 22 may not be fully sealed at this point, but simply tacked into place along the web 20.

The web 20, now having the zipper 22 attached to its surface, proceeds to the folding station 807, which includes a folding board 808 that folds the short section 36 away from the zipper 22 and toward the long section 38. Consequently, the zipper 22 is exposed at the edge of the web 22 after moving through the folding station 807.

The web 20, which has the zipper 22 attached to its surface in an exposed position, proceeds to the unit operations station 810. There, the web 20 may encounter a preseal station 812, a notching station 814, a slider station 816, and an end termination station 818. The preseal station 812 develops a preseal in the zipper 22 that is generally rectangular in shape with a heat sealing structure. The notching station 814 cuts away a portion of the preseal produced at the preseal station 812 such that the resulting preseal has a U-shape when the web 20 is viewed in its entirety, or an L-shape when one individual package is viewed by itself, as shown in the preseal 67 of the package 60 in FIG. 2. Such a notching procedure is disclosed in U.S. Pat. No. 6,286,189, which is incorporated herein by reference in its entirety. The slider 40 (FIGS. 1A–1H and 2) is then slid over the notch at the slider station 816. Such a procedure is also disclosed in U.S. Pat. No. 6,286,189.

The end terminations 66 (FIG. 2) may then be attached to the zipper 22 adjacent to the preseal. One type of end termination is in the form of a strap/clip that wraps over a top of a zipper. Further information concerning such an end termination may be found in U.S. Pat. No. 5,067,208, which is incorporated herein by reference in its entirety. One end of the strap is provided with a rivet-like member that penetrates through the zipper fins and into a cooperating opening at the other end of the strap. Other types of end termination are disclosed in U.S. Pat. Nos. 5,482,375, 5,448,807, 5,442,837, 5,405,478, 5,161,286, 5,131,121 and 5,088,971, which are incorporated herein by reference in their entireties. Injection-molded end terminations and ultrasonic welded end terminations may be used, as well.

Of course, the process 800 can use various methods for performing the unit operations. Further, while the process 800 can use several techniques for moving the web through the unit operations station 810, the movement through the unit operations station 810 is assisted by the use of a preferred shuttle system 820, which intermittently moves the web within the station 810 while the movement of the web outside the station 810 remains continuous. The shuttle system 820 is described below in detail in FIG. 20.

Once the web 20 has passed through the unit operations station 810, it proceeds to an unfolding station 830 such that the short section 36 is folded back toward its original position, which preferably is a position that is generally coplanar with the long section 38. At this point, the combination of the web 20 and the zipper 22, which has all of its auxiliary structures produced at the unit operations station 810, can be used in any type of form-fill-seal machines or flow-wrapping processes, such as the one described above, in which individual products 50 are placed at spaced locations along the web 20 and, subsequently, the web 20 is sealed at various regions to form the individual packages 60. Thus, the combination of the web 20 and the attached zipper 22 of the present invention is useful for flow-wrapping processes and all types of horizontal or vertical form-fill-seal machines.

By performing unit operations on the zipper 22 while the zipper 22 is attached to the web 20, the need for registration steps that are known in some prior art systems is obviated. When unit operations were performed on the zipper by itself, which is a relatively thin material, some of the unit operations, such as the punching of the notch, cause the zipper to stretch. This stretching resulted in the distance between adjacent notches to be inconsistent. Since the slider is inserted over the notch, the location at which the slider was to be introduced was not always the same. Thus, a registration step was often needed in prior art systems to attach the slider. Further, the prior art systems required an additional registration step to ensure that the cuts at the side edges of the packages (located at the notches) were at the proper locations.

In the present invention, the web 20 provides additional mechanical stability to the zipper 22 when unit operations are being performed on the zipper 22. Consequently, the zipper 22 does not undergo the same type of stretching as is seen when unit operations are performed on the zipper by itself.

Figure 17:
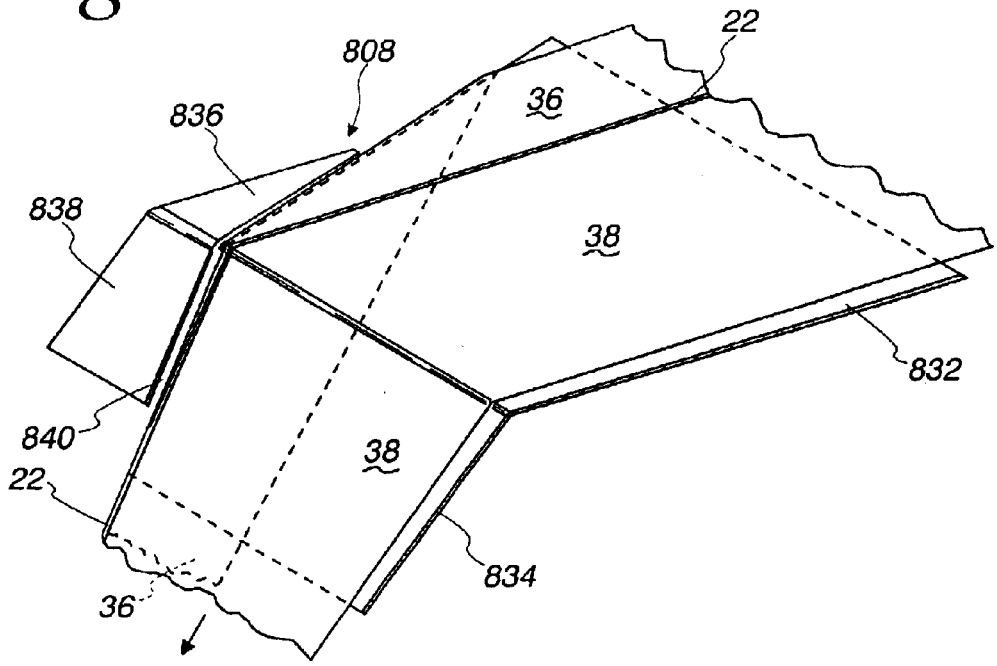
FIG. 17 is a detailed illustration of the folding board that is used to expose the zipper in FIG. 16.

FIG. 17 illustrates the details of one preferred folding board 808 used at the folding station 807 to expose the zipper in the machine 800 of FIG. 16. The folding board 808 has two pieces. A first piece includes a larger flat section 832 and a larger angled section 834, while the second piece includes a smaller flat section 836 and a smaller angled section 838. A gap 840 resides between the first piece and the second piece.

The web 20 with the attached zipper 22 moves along the larger flat section 832 toward the larger angled section 834. The short section 36 of the web 20 reaches a point of the larger flat section 32 where it begins to fold downwardly. This point is located before the upstream end of the gap 840. Eventually, substantially all of the short section 36 of the web 20 is folded downwardly to leave the zipper 22 exposed for unit operations. Preferably, the short section 36 is folded to a point where it is resting against the underside of the large section 38.

Figure 18:
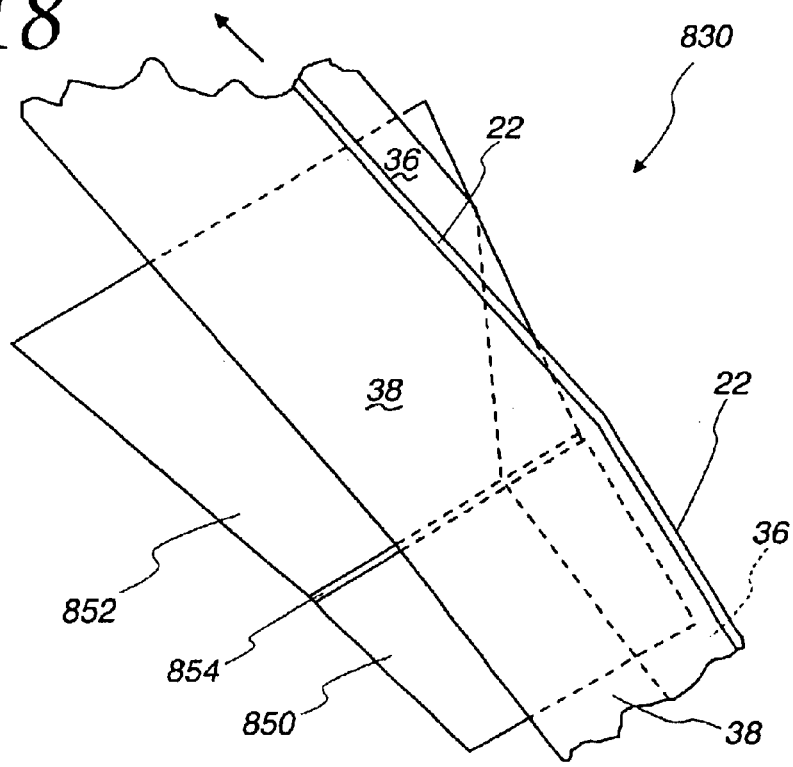
FIG. 18 is a detailed illustration of the folding board that is used to unfold the zipper and web combination in FIG. 16.

FIG. 18 illustrates the details of one preferred unfolding board 830 used in the machine of FIG. 16 to bring the short section 36 and the long section 38 into a generally coplanar position. The unfolding board 830 contains an upstream section 850 that intersects an expanding downstream section 852 at a joint 854. The downstream section 852 has edges that cause the folded short section 36 to unfold so as to be generally planar with the long section 38.

Figure 19:
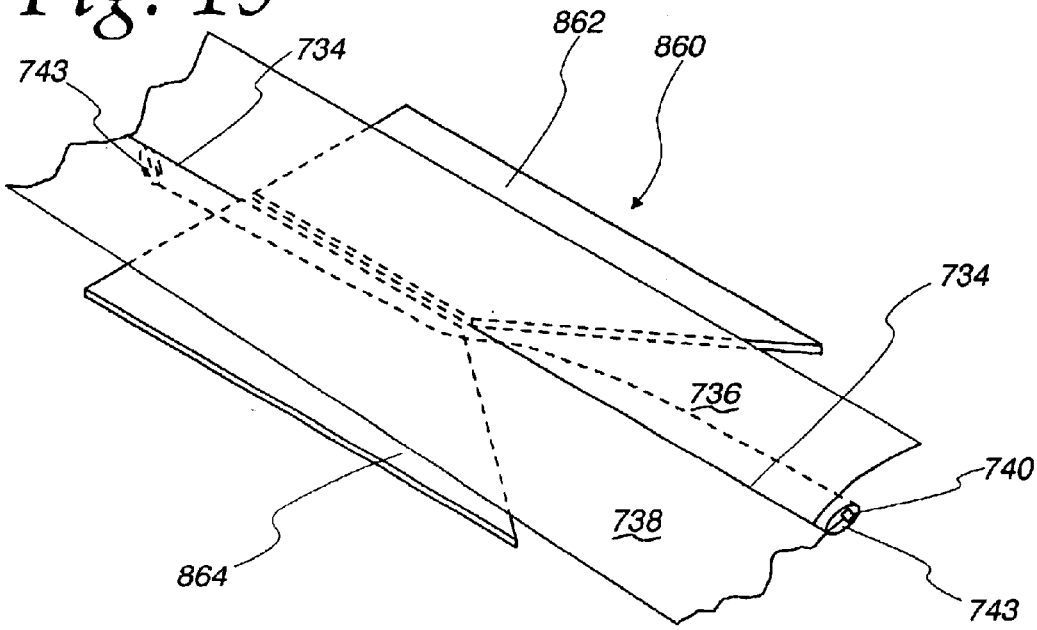
FIG. 19 is a detailed illustration of a folding board that is used to cause the zipper and web pocket around the zipper to transition to a generally perpendicular position with respect to the web.

FIG. 19 illustrates a special type of folding board 860 used in the processes of FIGS. 13A–13I and 15A–15J to cause the pouch 743 around the zipper 740 to drop to a position that is generally perpendicular with the first section 736 and the second section 738. The folding board 860 includes a first piece 862 and a second piece 864 that define a V-shaped entryway. The pocket 743, which is initially lying flat on the underside of first section 736, moves downwardly when engaging the first piece 862 within the V-shaped entryway and remains in this orientation as it exits the folding board 860.

Figure 20:
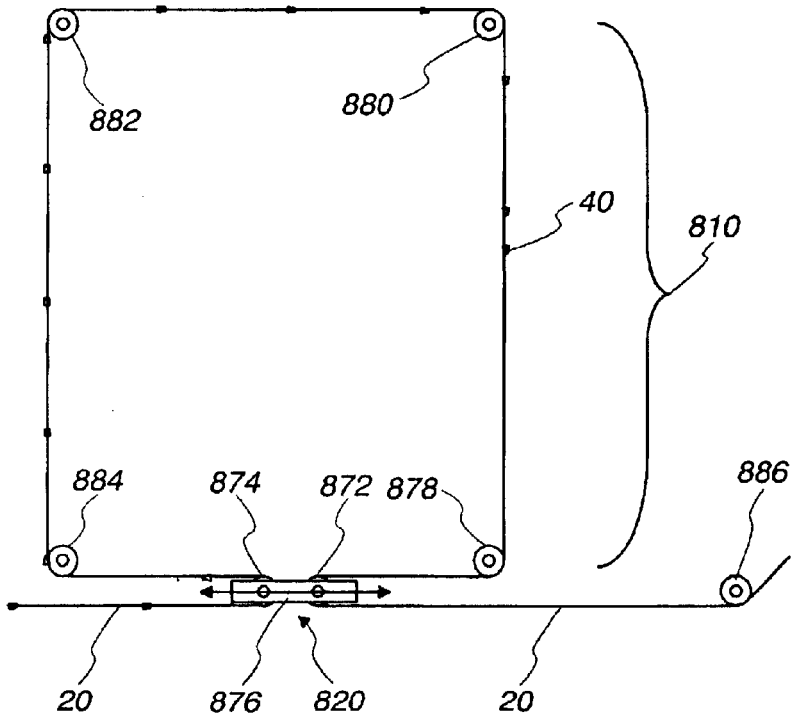
FIG. 20 illustrates the shuttle system that is used to perform the unit operations for the previously described processes, as shown in FIG. 16.

FIG. 20 illustrates the shuttle system 820 that is used to feed material into and out of the unit operation station 810 with a cycle time less than 1 second, and preferably about 0.3 to 0.4 seconds. The shuttle system 820 includes two rollers 872, 874 that are connected by a solid bar 876. The web 20 is fed into the unit operations station 810 through the entry roller 872 and exits the unit operation station 810 from the exit roller 874. Within the station 810, the web 20 moves across a plurality of rollers 878, 880, 882, 884 (in this case, four in number). Various unit operations described above occur in the station 810, including the placement of the sliders 40 on the exposed zipper 22 that is attached to the web 20.

The shuttle system 820 is designed to move cyclically to the left and to the right at a speed that is substantially equal to the feed rate of the moving web 20 as it enters and exits the station 810. As the shuttle system 820 moves to the left, the entry roller 872 takes up the web material moving toward the entry roller 872 from the roller 886. The movement to the left of the shuttle system causes the web 20 within the station 810 to remain stationary for the unit operations to be performed. While moving to the left, the exit roller 874 allows the web to be released from the station 810 at the rate it is entering.

Then, as the shuttle system 820 moves to the right, the entry roller 872 feeds web material into the unit operations station 810 at twice the feed rate of the web 20 that enters from the roller 886. Thus, the shuttle's movement to the right causes the movement of web 20 from one unit function to the next unit function within the unit operations station 810 (e.g., from the preseal unit function to the notching unit function, from the notching unit function to the slider installation unit function, etc.). While the web is being fed into the unit operations station 810 at twice the rate, the movement of the exit roller 874 to the right causes the exit roller 874 to take up some of the material of the moving web, such that the web 20 exits the exit roller 874 at the normal rate of web movement from the roller 886.

The shuttle system 820 can be moved through the use of a standard motor or through the reciprocating movement of a solenoid.

Figure 21A:
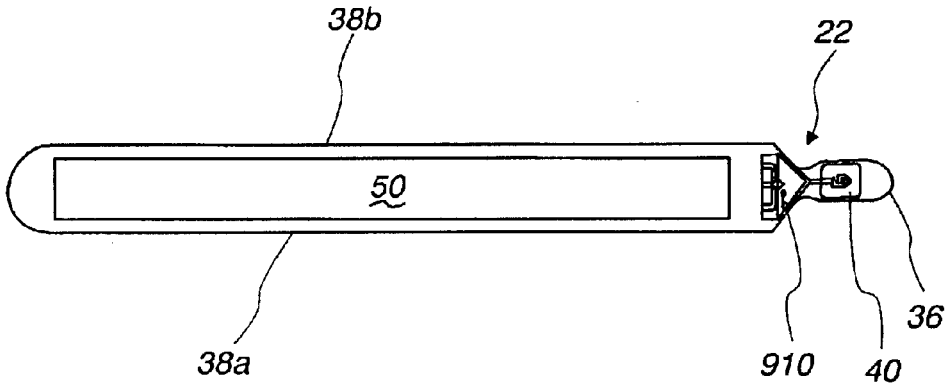
FIGS. 21A–21B illustrate a gas lance that is used to back-fill the package with a gas while also providing a surface against which the package of the panel can be sealed to the zipper.
Figure 21B:
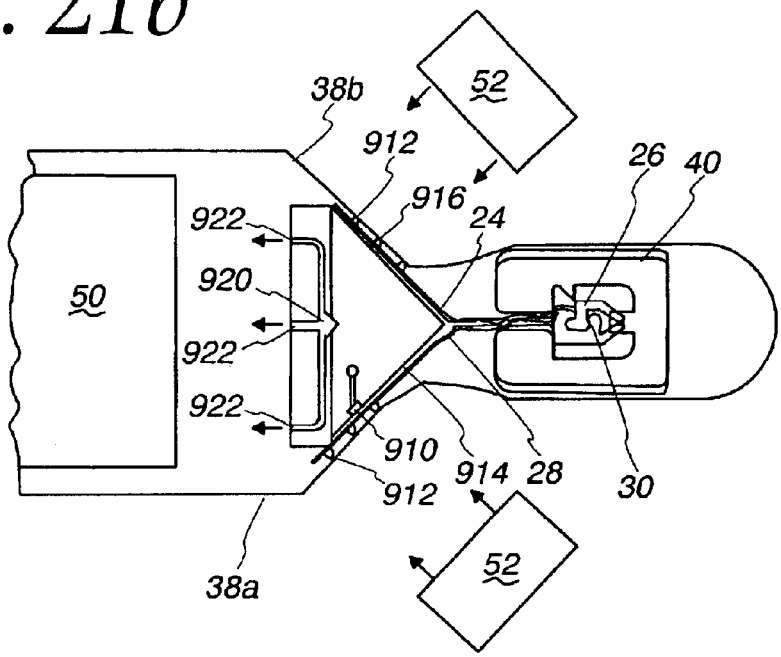

FIGS. 21A and 21B illustrate a gas lance 910 that can be used in conjunction with any of the aforementioned processes described with respect to FIGS. 1A–15J. FIGS. 21A and 21B will be discussed with respect to the process and structures illustrated in FIGS. 1A–1H, and would take place during the steps illustrated in FIGS. 1G–1H. As shown in FIG. 21A, the product 50 is surrounded by the first package panel **38*a* and the second package panel 38*b*. At this point, the second package panel 38*b* has not been attached to the zipper 22. Because the product 50 may be preserved better when it is maintained in a certain gaseous environment, the lance 910 is used to inject a certain gas between the first package panel 38*a* and the second package panel 38*b*. According to the present invention, however, the gas lance 910 serves an additional purpose, which is to form a surface against which the second package panel 38*b* can be attached to the zipper 22**.

As shown best in FIG. 21B, the geometry of the gas lance 910 serves to spread the first fin 24 of the zipper 22 away from the second fin 28 of the zipper 22. The first fin 24 and the second fin 28 preferably include a plurality of sealing ribs 912 that allow it to be better attached to the web 20. The lance 910 has a first surface 914 and a second surface 916 that are generally perpendicular to each other. These surfaces 914, 916, however, do not need to be at 90 degrees to perform the function of the present invention. These surfaces 914, 916 resist the force of the heat sealing structures 52 when the heat sealing structures 52 are pressed against the package panels 38*a*, 38*b* of the web 20 to secure the fins 24, 28 to the web 20. Because the zipper 22 may only initially be tacked with adhesive to the web 20, both fins 24, 28 may still require a heat sealing step.

The lance 910 also includes a central manifold 920 extending along its length that delivers the gas to a plurality of openings 922 that are directed toward the interior of the package adjacent to the product 50. The configuration of the manifold 920, the configuration of the openings 922 along the length of the lance 910, and the geometry of the periphery of the lance 910 will depend on the application for which the lance 910 is used. For example, the lance 910 may have a hexagonal cross-sectional shape with two adjacent surfaces at 120 degrees from each other serving the function of the surfaces 914, 916. Generally, the lance 910 has a length that is equal to the width of one or more packages, so that it is possible to flush and seal more than one package at a time.

Accordingly, the lance 910 serves two functions, sealing the fins 24, 28 to the package panels 38*a*, 38*b* and injecting gas into the region defined by the package panels 38*a*, 38*b*. In doing so, the lance 910 reduces the amount of material that is required for the web 20. Specifically, in prior art systems, the heat sealing of the fins of the zipper to the web was brought about through the movement of the heat sealing structures 52 in opposing directions, as is shown in FIG. 1H. If the heat sealing is done in this fashion where the heat sealing structures are moving in generally opposite directions (as opposed to a 90 degree angle when the lance 910 is used), then additional material for the web 20 is needed between the slider 40 and the product 50 to allow the heat sealing structures 52 to move into place and oppose each other. Further, additional material is needed in the prior art systems to further accommodate a distinct gas lance, which would be positioned between the package panels above the product and below the heat sealing structures 52. In other words, the lengths of the first and second package panels 38*a*, 38*b* between the lowermost portion of the slider 40 and the uppermost edge of the product 50 are shorter when the inventive lance 910 is used.

While the present invention has been described with reference to one or more particular embodiments, those skilled in the art will recognize that many changes may be made thereto without departing from the spirit and scope of the present invention. For example, while this specification has referred to the two sections of the web as being, in some instances, a short section and a long section, the invention is useful if those sections are reversed or if they are of equal length. Each of these embodiments and obvious variations thereof is contemplated as falling within the spirit and scope of the claimed invention, which is set forth in the following claims.

What is claimed is:

1. A process for packaging a product, comprising:

a. moving a flat web of material having a first edge and a second edge;

b. providing a zipper including first and second interlocking members;

c. attaching said first interlocking member to said web on a line that is closer to said first edge to divide said web into a short segment and a long segment, said short and long segments extending longitudinally in a direction of movement of said web;

d. folding said short segment away from said zipper;

e. attaching a slider to said zipper;

f. folding said short segment back toward said zipper;

g. placing said product adjacent to said long segment;

h. folding said long segment over said product;

i. attaching said long segment to said second interlocking member;

j. sealing said short segment to said long segment at a region adjacent to said first and second edges; and k. forming individual packages of said product from said web.

2. The method of claim 1, wherein each of said first and second interlocking members includes fins, said steps of attaching said long segment to said second interlocking member and attaching said first interlocking member to said web including, respectively, attaching said long segment to said fin of said second interlocking member and attaching said fin of said first interlocking member to said web.

3. The method of claim 2, further including cutting spaced notches in said zipper and providing end stops on said zipper adjacent to each side of said notches.

4. The method of claim 3, wherein said step of attaching said slider occurs after said step of cutting spaced notches.

5. The method of claim 1, wherein said steps of attaching said long segment to said second interlocking member and sealing said shorter segment to said longer segment occur simultaneously.

6. The method of claim 1, wherein said step of providing a zipper includes providing a zipper with said first and second interlocking members being interlocked.

7. The method of claim 1, wherein said step of folding said short segment away from said zipper includes placing said short segment against said long segment.

8. The method of claim 1, wherein said step of folding said short segment back toward said zipper includes placing said short segment in a plane generally parallel to said long segment.

9. The method of claim 1, wherein said step of sealing said shorter segment to said longer segment includes forming a header for said individual packages.

10. A process for packaging a product, comprising:

a. providing a flat web of material having first and second edges and a zipper including first and second interlocking members, said first interlocking member being attached to said web on a line that is closer to said first edge;

b. exposing said zipper while said zipper is attached to said flat web;

c. subsequent to exposing said zipper, performing unit operations on said zipper while said zipper is attached to said flat web;

d. placing said product on said flat web between said zipper and said second edge;

e. folding said flat web around said product such that said second edge is near said first edge;

f. forming a header from a region of said web adjacent to said first edge and a region of said web adjacent to said second edge;

g. attaching said second interlocking member to said web; and h. forming individual packages from said web.

11. The process of claim 10, wherein said step of exposing includes folding said flat web.

12. The process of claim 10, wherein said steps of forming a header and attaching said second interlocking member to said web occur simultaneously.

13. The process of claim 10, wherein said unit operations include attaching a slider to said zipper.

14. A process for packaging a product, comprising:

a. providing a flat web of material having first and second edges and a zipper including first and second interlocking members, said first interlocking member being attached to said web on a line that is closer to said first edge;

b. folding said first edge back toward said second edge to expose a top and bottom of said zipper;

c. cutting a series of spaced notches on said zipper while said top and bottom of said zipper are exposed, each of said notches being located at a side edge of individual packages formed by said flat web;

d. moving sliders over said zipper at said notches;

e. folding said first edge back toward said zipper;

f. placing product between said zipper and said second edge;

g. folding said flat web around said product such that said second edge is near said first edge;

h. forming a header from a region of said web adjacent to said first edge and a region of said web adjacent to said second edge;

i. attaching said second interlocking member to said web; and j. forming individual packages from said web.

15. The process of claim 14, further including the step of adding end terminations to said zipper on both sides of each of said notches.

16. The process of claim 14, wherein said steps of forming a header and attaching said second interlocking member occur simultaneously.

17. The process of claim 14, wherein said folding said first edge back toward said second edge includes contacting said first edge to said flat web.

18. The process of claim 14, further including adding a preseal to said zipper at spaced locations, said cutting said spaced notches occurring at said preseals.

19. The process of claim 14, wherein said product is food.

20. A process for packaging product, comprising:

a. moving a flat web of material having a first edge and a second edge;

b. providing a zipper including first and second interlocking members;

c. attaching said first interlocking member to said web on a line that is closer to said second edge to divide said web into a first segment and a second segment, said first and second segments extending longitudinally in a direction of movement of said web;

d. folding said first segment away from said zipper;

e. attaching a slider to said zipper;

f. folding said first segment toward said zipper;

g. placing said product adjacent to said second segment;

h. folding said first segment over said product;

i. attaching said first segment to said second interlocking member;

j. sealing said first segment to said second segment at a region adjacent to said first and second edges; and k. forming individual packages from said web.

21. The process of claim 20, wherein said steps of attaching said first segment to said second interlocking member and sealing said first segment to said second segment occurs simultaneously.

22. The process of claim 20, wherein said step of attaching said first interlocking member to said web includes tacking said first interlocking member to said web.

23. The process of claim 22, wherein said step of attaching said first segment to said second interlocking member causes a permanent heat sealing of said first interlocking member to said web.

24. The process of claim 20, wherein said sealing said first segment to said second segment includes forming a header.

* * * * *